US011879643B1

(12) United States Patent
Strutz et al.

(10) Patent No.: US 11,879,643 B1
(45) Date of Patent: Jan. 23, 2024

(54) APPLIANCE WITH REMOVABLE PANEL

(71) Applicant: Sub-Zero Group, Madison, WI (US)

(72) Inventors: Adam Strutz, Madison, WI (US); Andrew Huerth, Madison, WI (US); Bronson Blum, Madison, WI (US); Matthew Skemp, Madison, WI (US); Curt Scadden, Madison, WI (US)

(73) Assignee: Sub-Zero Group, Madison, WI (US)

( * ) Notice: Subject to any disclaimer, the term of this patent is extended or adjusted under 35 U.S.C. 154(b) by 294 days.

(21) Appl. No.: 17/226,983

(22) Filed: Apr. 9, 2021

(51) Int. Cl.
*F24C 15/00* (2006.01)
*A47B 88/48* (2017.01)

(52) U.S. Cl.
CPC ..... *F24C 15/007* (2013.01); *A47B 88/48* (2017.01); *F24C 15/003* (2013.01)

(58) Field of Classification Search
CPC ..... F16C 29/008; F16C 33/306; A47B 88/45; A47B 88/48; F24C 15/007; F24C 15/003
See application file for complete search history.

(56) References Cited

U.S. PATENT DOCUMENTS 2,749,201 A * 6/1956 Koury ..... A47B 88/48 312/350
6,846,052 B2 * 1/2005 Kelley ..... A47B 21/0314 312/238
8,152,250 B2 * 4/2012 Aguilar Ante ..... A47B 88/46 312/331
9,833,072 B1 * 12/2017 Knake ..... A47B 96/025
9,950,673 B2 * 4/2018 Granzotto ..... A47B 88/402
11,209,207 B2 * 12/2021 Wang ..... A47B 88/45
11,297,729 B2 * 4/2022 Potter ..... A47B 88/48
2008/0315743 A1 * 12/2008 Oh ..... A47B 88/43 312/350
2009/0261698 A1 * 10/2009 Cabal Velarde ..... A47B 88/493 312/334.1
2010/0206414 A1 * 8/2010 Adamczak ..... A47J 27/04 137/800
2016/0174713 A1 * 6/2016 Dubina ..... A47B 88/40 29/434
2017/0184151 A1 * 6/2017 Huang ..... F16C 29/02
(Continued)

FOREIGN PATENT DOCUMENTS

CN 105476458 A * 4/2016 ..... A47J 27/04
CN 207575013 U * 7/2018
(Continued)

*Primary Examiner* — Hanh V Tran
(74) *Attorney, Agent, or Firm* — Foley & Lardner LLP

(57) ABSTRACT

A movable panel assembly for an appliance includes a panel coupled to an appliance chassis via a cam mechanism, which is actuated by a stationary motor. The cam mechanism includes two parallel linkage portions, wherein each of the linkage portions are coupled to opposite ends of the panel. Each linkage portion includes a rack mounted to a sliding rail, which is translated by the motor via a gear engaging with the rack to move a plate. The plate includes a pin coupled to a cam follower, the pin being configured to translate within a channel disposed within a cam plate. The cam follower is configured to cause the panel to horizontally translate, pivot, and vertically translate relative to the chassis, thereby facilitating access to a component housing unit disposed behind the panel when the panel assembly is in a closed configuration.

14 Claims, 24 Drawing Sheets

(56) References Cited

U.S. PATENT DOCUMENTS

| | | | | |
|---|---|---|---|---|
| 2017/0347795 | A1* | 12/2017 | Knake | A47B 96/025 |
| 2018/0187897 | A1* | 7/2018 | Kim | H05K 7/16 |
| 2021/0022496 | A1* | 1/2021 | Subrahmanya | A47B 88/45 |
| 2021/0356135 | A1* | 11/2021 | Liu | F24C 15/003 |

FOREIGN PATENT DOCUMENTS

| | | | | | |
|---|---|---|---|---|---|
| CN | 108852031 | A | * | 11/2018 | |
| CN | 109602272 | A | * | 4/2019 | A47J 27/04 |
| CN | 109805780 | A | * | 5/2019 | |
| CN | 109846377 | A | * | 6/2019 | |
| CN | 209067055 | U | * | 7/2019 | |
| CN | 110101299 | A | * | 8/2019 | A47J 27/04 |
| CN | 110123129 | A | * | 8/2019 | A47J 27/04 |
| CN | 209661267 | U | * | 11/2019 | A47J 27/04 |
| CN | 209661365 | U | * | 11/2019 | A47J 27/04 |
| CN | 111053451 | A | * | 4/2020 | |
| CN | 210959056 | U | * | 7/2020 | |
| CN | 211380784 | U | * | 9/2020 | |
| CN | 211582728 | U | * | 9/2020 | |
| CN | 212438241 | U | * | 2/2021 | |
| EP | 2172142 | A1 | * | 4/2010 | A47L 15/4293 |
| EP | 3594573 | A1 | * | 1/2020 | A47J 27/04 |
| WO | WO-2014206481 | A1 | * | 12/2014 | D06F 34/28 |
| WO | WO-2019205674 | A1 | * | 10/2019 | A47B 88/45 |

* cited by examiner

APPLIANCE WITH REMOVABLE PANEL

BACKGROUND

The present disclosure relates generally to appliances for use in home and/or commercial applications. More specifically, the disclosure relates to appliances having a movable panel configured to facilitate access to one or more features disposed behind the panel.

Many appliances are often designed to include one or more panels that may be removed in order to enable access to controls and/or components disposed behind the panel. Such components may include, but are not limited to one or more water tanks or reservoirs. Frequently, these panels require complex manipulation by a user and/or removal of many fasteners to enable access to said controls and/or components. Such involved processes are often cumbersome and time consuming.

Accordingly, it would be advantageous to provide an appliance having a movable panel that does not require complex manipulation or removal of fasteners by a user, wherein the panel may facilitate access to one or more components, such as a water tank or reservoir, disposed behind the panel.

SUMMARY

According to one aspect of the present disclosure, a movable panel assembly includes a panel, a cam mechanism coupled to the panel, and a stationary motor operably coupled to the cam mechanism, such that the stationary motor causes operation of the cam mechanism. The cam mechanism includes a rack mounted to a slidable rail, a plate rotatably coupled to the slidable rail, a first cam follower, and a second cam follower. The rack is configured to engage with a gear driven by the motor and the plate includes a curved first groove disposed therethrough. The first cam follower is configured such that a first end of the first cam follower is rotatably coupled to the plate on a first side of the plate, and a second end of the first cam follower is coupled to the panel. The second cam follower is configured such that a first end of the second cam follower is coupled to the plate on a second side of the cam plate, and a second end of the second cam follower is coupled to the panel. The second cam follower also includes a first pin and a second pin, wherein the first and second pins are configured to respectively translate within first and second channels of a cam plate, the cam plate being coupled to a chassis of an appliance. Operation of the cam mechanism causes the panel to move relative to the chassis.

In various embodiments, the panel is a control panel having one or more adjustable controls and a display disposed thereon. In some embodiments, the panel is configured to move from a first position to a second position responsive to operation of the cam mechanism by the stationary motor. In other embodiments, the panel is disposed adjacent the chassis in the first position. In various embodiments, when the panel is in the second position, the panel is disposed a horizontal distance from the chassis and an upper edge of the panel is at a same height as an upper edge of an adjacent appliance functional unit. In some embodiments, the panel includes one or more plates disposed on an inner surface of the panel, wherein the plates are operably coupled to one or more eccentric cams, and wherein the one or more eccentric cams are configured to adjust the one or plates to consequently adjust a rotational orientation of the panel relative to the cam mechanism.

In various embodiments, the stationary motor is configured to vary at least one of a speed of operation or an applied torque based on a position of at least one of the first pin or second pin within the respective first channel or second channel. In various embodiments, the stationary motor is configured to vary at least one of a speed of operation or an applied torque based on a friction or torque threshold. In some embodiments, the stationary motor is configured to vary at least one of a speed of operation or an applied torque based on a position of the panel relative to the chassis. In other embodiments, the movable panel assembly further includes a spring coupled to the plate, wherein the spring is rotatably coupled to a third pin disposed within the curved channel and rotatably coupled to the first end of the first cam follower. In various embodiments, the second channel of the cam plate includes a first linear portion, a second linear portion, and an inclined portion disposed therebetween. In some embodiments, the second linear portion is disposed at a height greater than a height of the first linear portion. In other embodiments, each of the first and second linear portions of the second channel are substantially parallel to the first channel. In some embodiments, the inclined portion includes a detent, wherein the detent is configured to stop translation of the second pin within the second channel.

According to another aspect of the present disclosure, an appliance includes a functional unit, a component housing unit disposed above the functional unit, and a movable panel assembly coupled to the component housing unit. The movable panel assembly includes a rack mounted to a slidable rail, a plate rotatably coupled to the slidable rail, a first cam follower, and a second cam follower. The rack is configured to engage with a gear driven by the motor. The plate includes a curved first groove disposed therethrough. The first cam follower includes a first end of the first cam follower that is rotatably coupled to the plate on a first side of the plate, and a second end of the first cam follower that is coupled to the panel. The second cam follower includes a first end of that is coupled to the plate on a second side of the plate, and a second end of the second cam follower that is coupled to the panel. The second cam follower also includes a first pin and second pin, wherein the first and second pins are configured to respectively translate within first and second channels of a cam plate, and wherein the cam plate is coupled to a chassis of the appliance. Operation of the cam mechanism causes the panel to move relative to the chassis.

In various embodiments, the functional unit is a steam oven. In some embodiments, the component housing unit includes one or more water reservoirs disposed therein. In other embodiments, the panel is configured to move from a first position to a second position responsive to operation of the cam mechanism by the stationary motor. In various embodiments, when the panel is in the first position, the panel is disposed adjacent the chassis and in the second position, the panel is disposed a horizontal distance from the chassis and an upper edge of the panel is at a same height as an upper edge of the functional unit. In some embodiments, the component housing unit is configured to receive one or more water reservoirs, and wherein the upper edge of the panel is configured to guide placement of the one or more water reservoirs when the panel is in the second position.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

Figure 1:
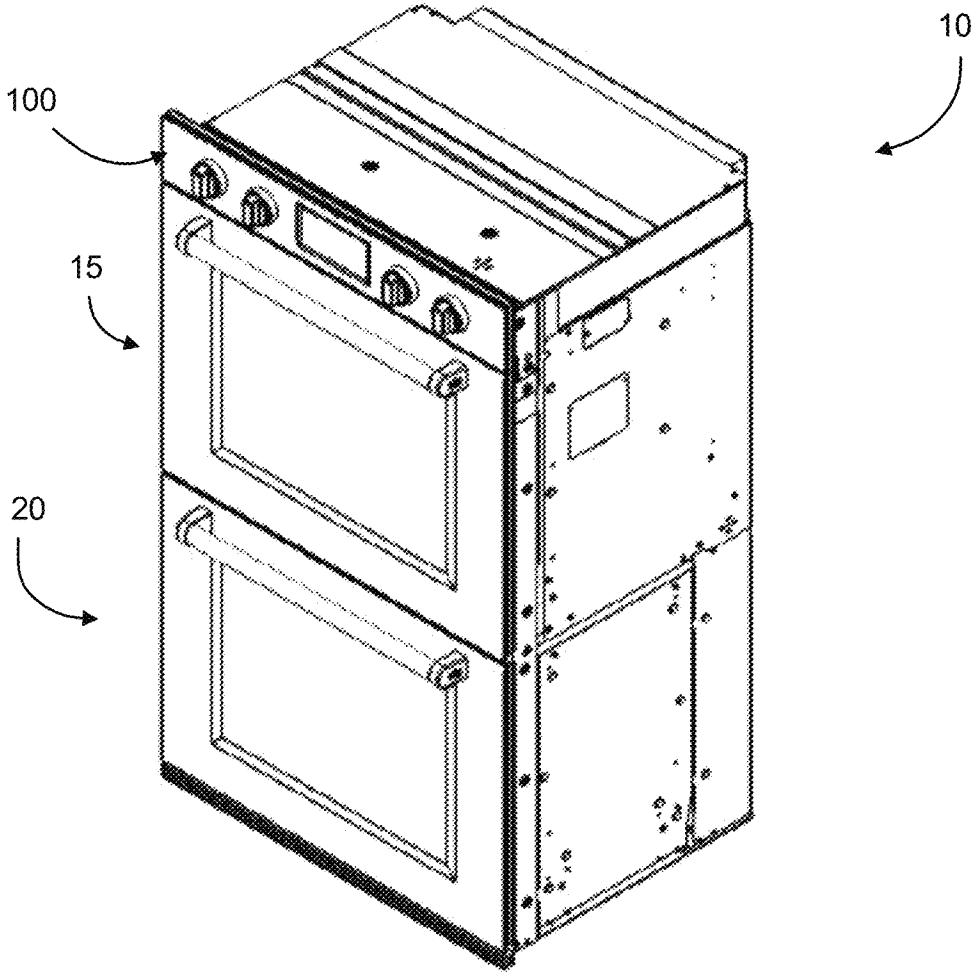
FIG. 1 is a perspective view of an appliance having a movable panel disposed in a closed position, according to an exemplary embodiment.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Figure 3:
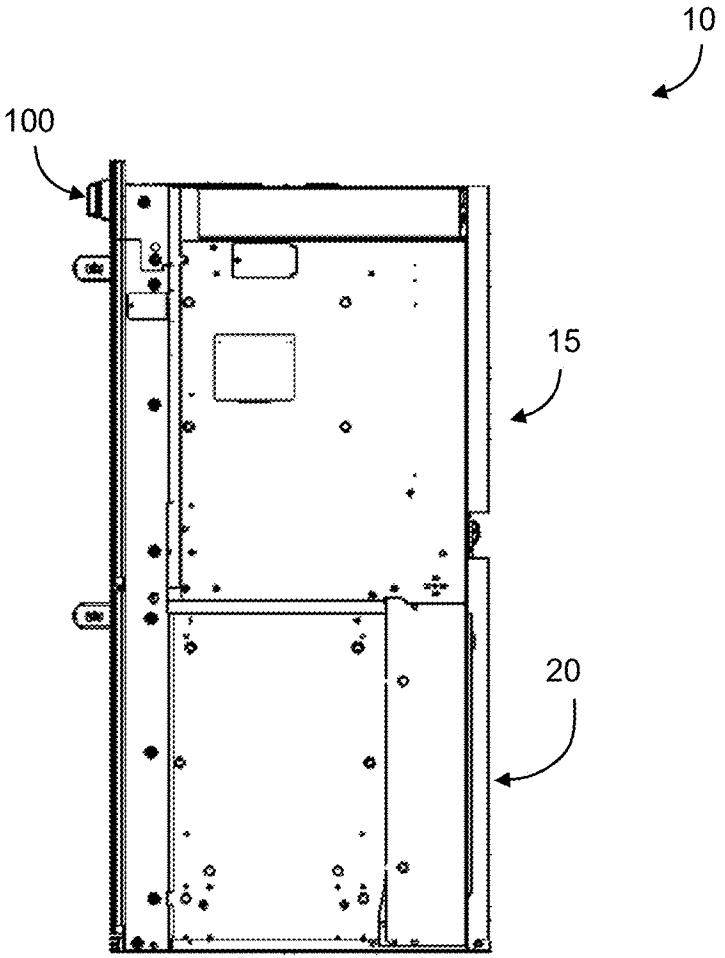
FIG. 3 is a side view of the appliance of FIG. 1, according to an exemplary embodiment.
Figure 2:
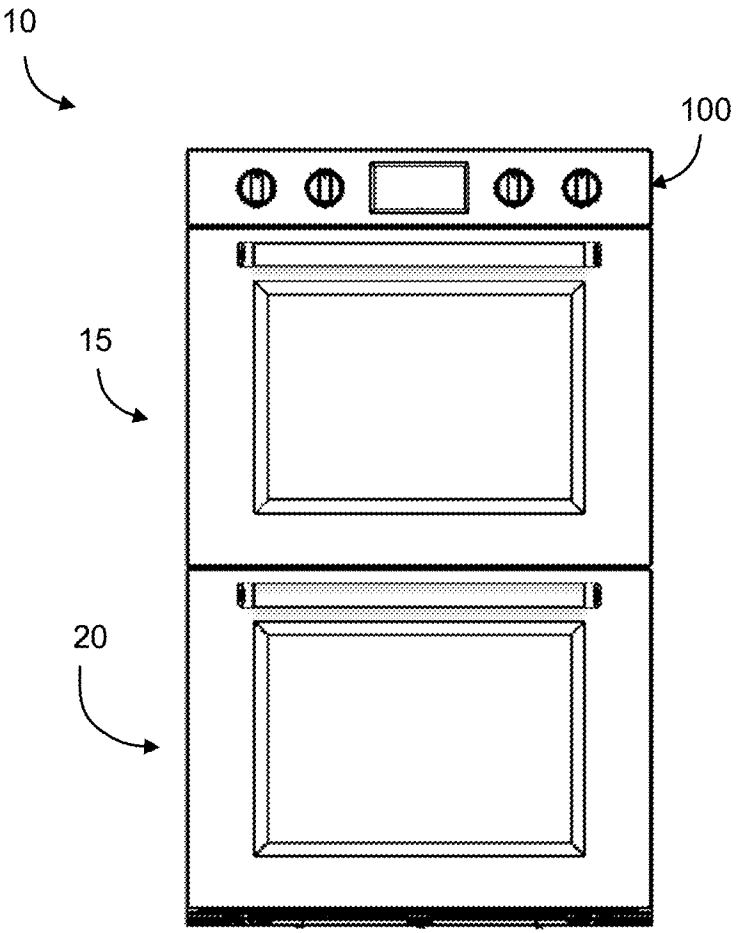
FIG. 2 is a front view of the appliance of FIG. 1, according to an exemplary embodiment.

Referring to FIGS. 1-3, perspective, front, and side views, respectively, of an appliance 10 having a movable panel assembly 100 in a closed position are shown, according to an exemplary embodiment. As shown, appliance 10 includes functional units 15 and 20 disposed below the movable panel assembly 100. Although FIGS. 1-3 depict appliance 10 as an oven appliance wherein functional units 15 and 20 are ovens with the movable panel assembly 100 disposed above, the appliance 10 may be any household or commercial appliance (e.g., dishwasher, laundry appliances, etc.).

Figure 4:
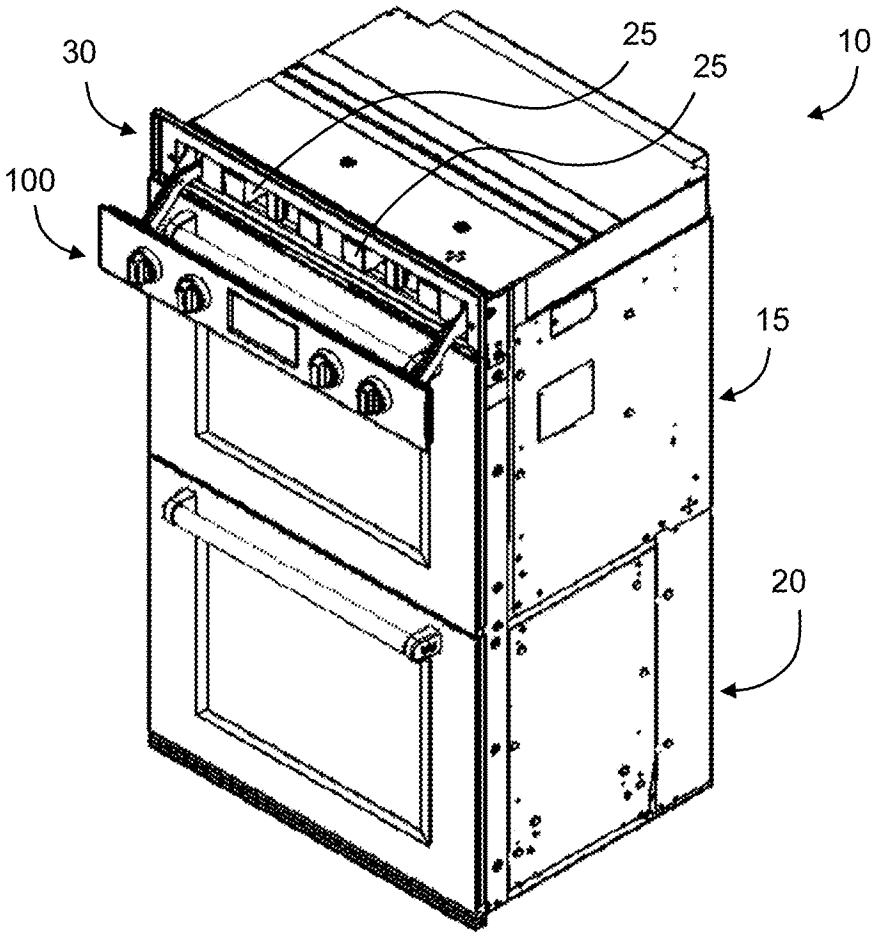
FIG. 4 is a perspective view of the appliance of FIG. 1 illustrating the movable panel in an open position, according to an exemplary embodiment.
Figure 6:
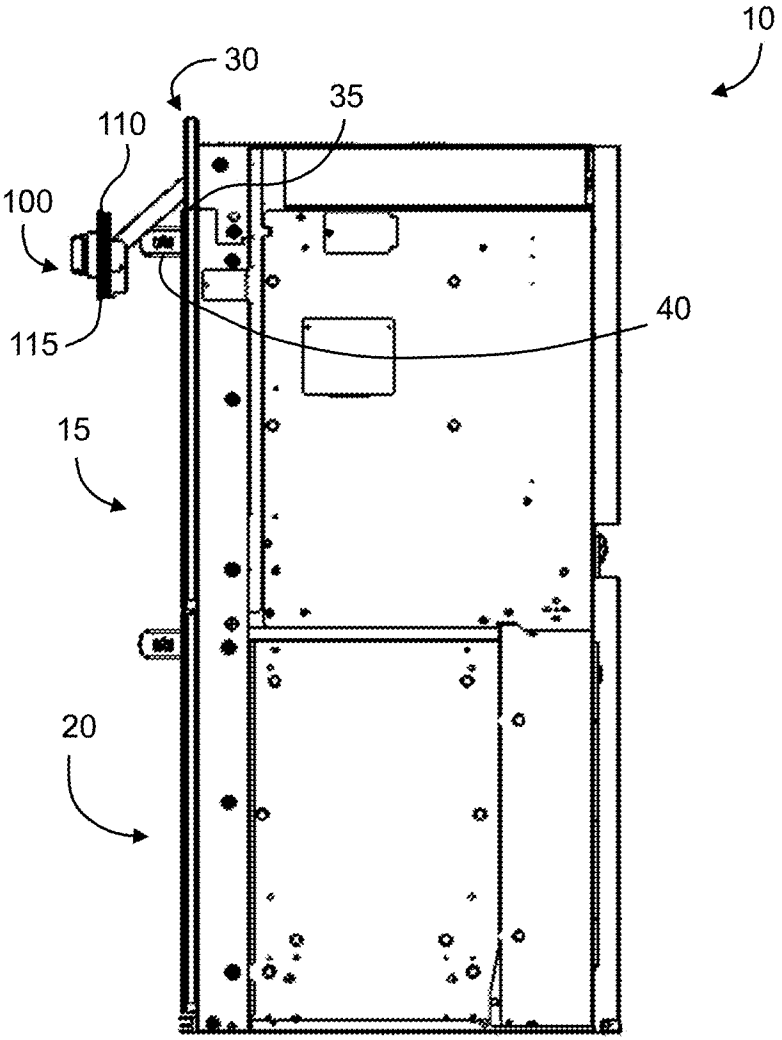
FIG. 6 is a side view of the appliance of FIG. 4, according to an exemplary embodiment.
Figure 5:
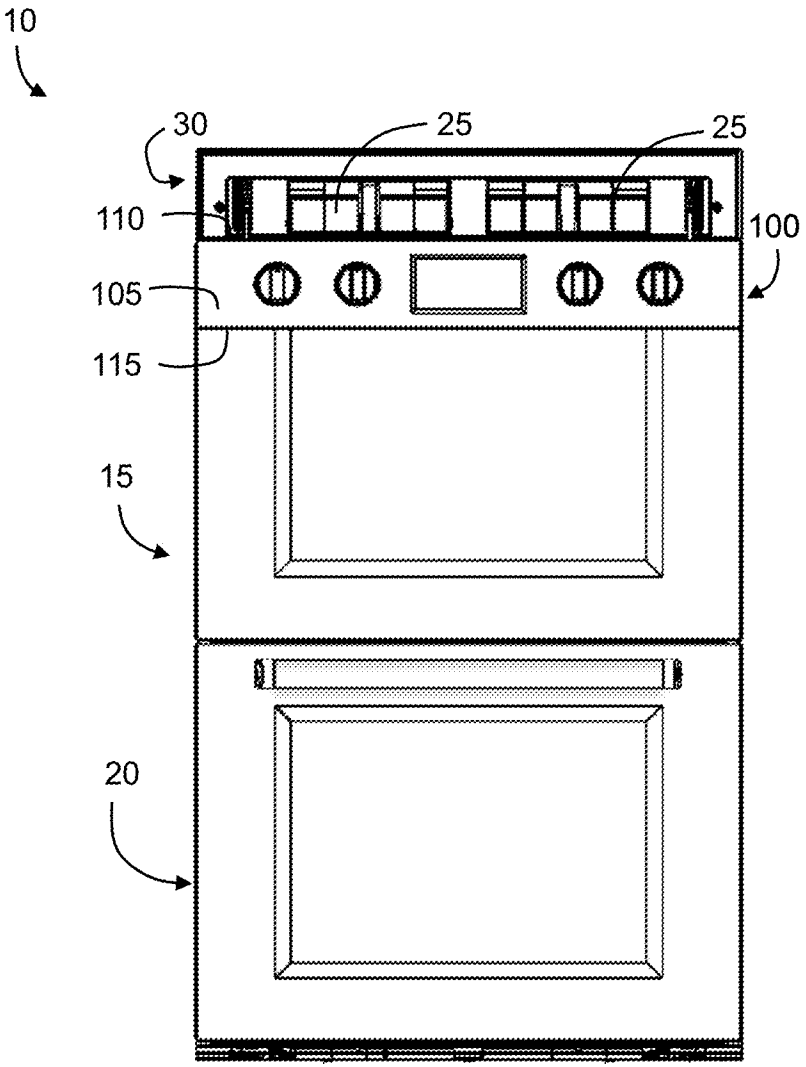
FIG. 5 is a front view of the appliance of FIG. 4, according to an exemplary embodiment.

FIGS. 4-6 show perspective, front, and side views of the appliance 10 with the movable panel assembly 100 in an open position, according to an exemplary embodiment. As illustrated, the movable panel assembly 100 may be configured to translate both horizontally and vertically relative to the appliance 10 to facilitate access to a component housing unit 30 disposed above functional unit 15. In various embodiments, the functional unit 15 may be a steam oven requiring water supply from a water reservoir. Accordingly, the movable panel assembly 100 may be opened to allow access, removal, and/or replacement of one or more water reservoirs 25, which may be disposed within the component housing unit 30.

Figure 7:
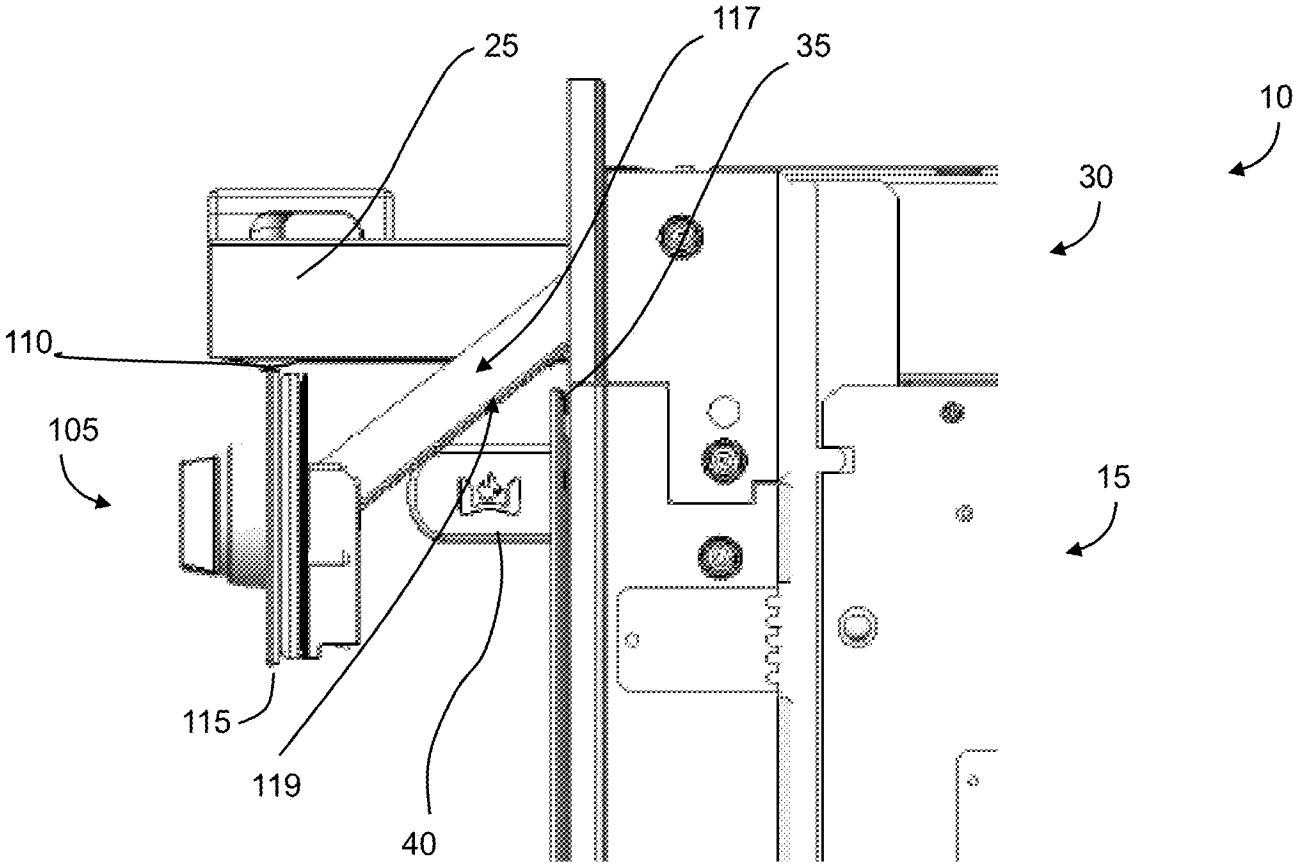
FIG. 7 is a side view of the appliance of FIG. 4 near the component housing unit, illustrating the movable panel in an open position thereby enabling access to water reservoirs disposed behind said panel, according to an exemplary embodiment.

As shown, the movable panel assembly 100 includes a panel 105, which has an upper edge 110 and a lower edge 115. In various embodiments, the upper edge 110 may be an uppermost edge of the panel 105 and the lower edge 115 may be a lowermost edge of the panel 105. In various embodiments, the panel 105 may be a control panel having a display and/or one or more controls for operating the appliance 10. The movable panel assembly 110 may be configured such that the lower edge 115 of the panel 105 is disposed adjacent an upper edge 35 of the functional unit 15 when the assembly 100 is in a closed configuration. In various embodiments, the upper edge 35 of the functional unit 15 may be an uppermost edge of the functional unit 15. When the movable panel assembly 100 is in an open configuration, the upper edge 110 of the panel 105 may be disposed at the same or a substantially similar height as the upper edge 35 of the functional unit 15, as illustrated in FIGS. 4-6. In various embodiments, the upper edge 110 of the panel 105 may be configured to support placement of the one or more water reservoirs 25 during removal and/or replacement of the water reservoirs 25 within the components housing unit 30. In various embodiments, the upper edge 110 of the panel 105 may be used as a guide to facilitate placement of the one or more water reservoirs 25 within the components housing unit 30. In various embodiments, the movable panel assembly 100 may be configured to horizontally translate such that the panel 105 does not contact, or minimally contacts, a handle 40 disposed on the functional unit 15. In various embodiments, the movable panel assembly 100 may include one or more bumpers or guards disposed behind the panel 105 to prevent any potential abrasive contact between components of the movable panel assembly 100 and components of the appliance 10 (e.g., handle 40). As shown in FIG. 7, one or more protective elements 119 (e.g., coating, bumper, guard, etc.) may be disposed along one or more linkage components 117 included within the movable panel assembly 100, wherein the linkage components 117 are configured to facilitate coupling and movement of the panel 105 relative to the component housing unit 30. The protective elements 119 may be configured to prevent abrasive or other detrimental contact between the linkage components 117 and the upper edge 35 and/or handle 40 of the functional unit 15. In various embodiments, the protective elements 119 may be configured as a protruding feature coupled to or integrally formed within the linkage components 117.

Figure 9:
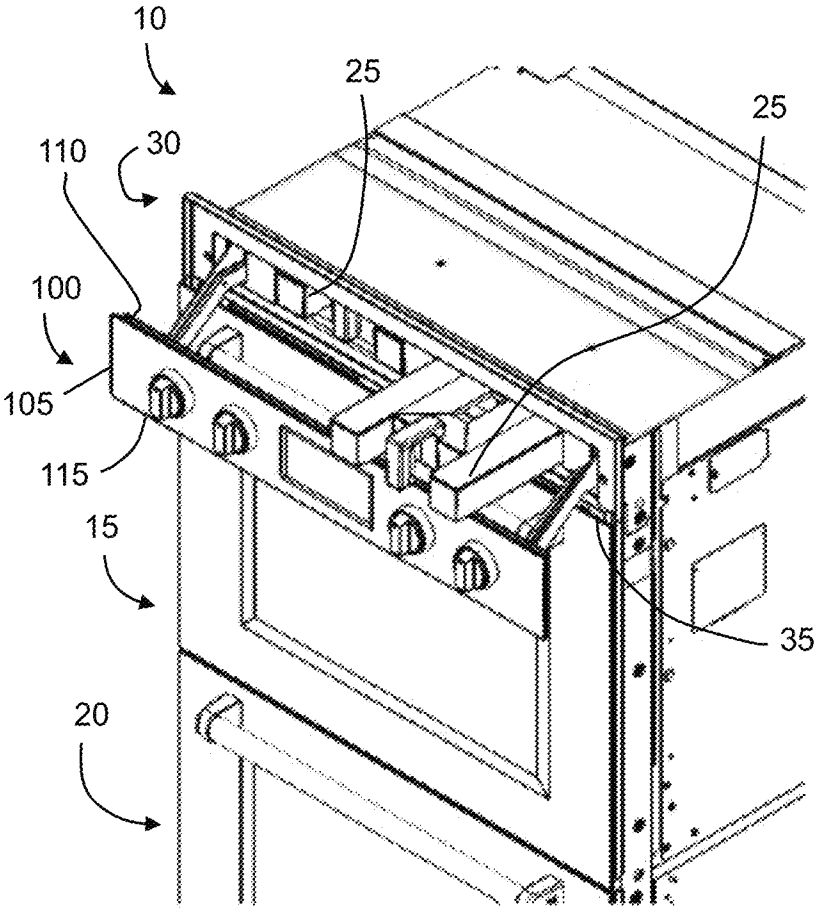
FIGS. 8-9 are perspective views of the appliance of FIG. 4 illustrating the movable panel in an open position thereby enabling access to water reservoirs disposed behind said panel, according to an exemplary embodiment.
Figure 8:
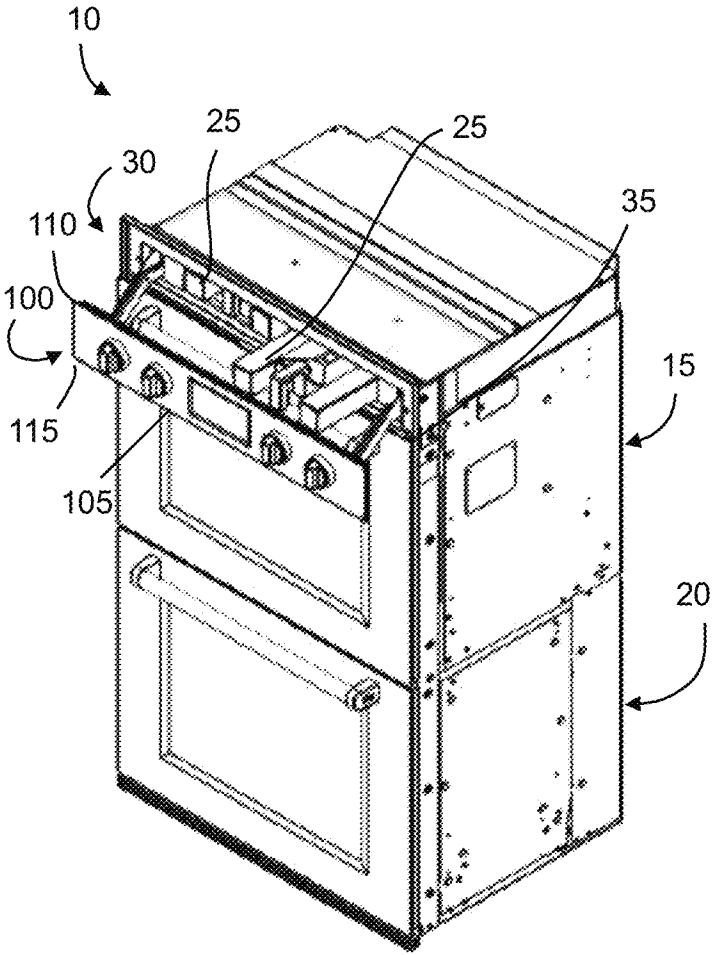

FIG. 8 shows movable panel assembly 100 in an open configuration, according to an exemplary embodiment. As shown, when the movable panel assembly 100 is in the open configuration, the panel 105 is disposed at a height lower than the height of the panel 105 when the movable panel assembly 100 is in the closed configuration. Accordingly, when in the open configuration, the movable panel assembly 100 enables a user to view and/or access the panel 105. In various embodiments, when the panel assembly 100 is in the open configuration, the panel 105 may be disposed such that the upper edge 110 of the panel 105 is at the same or substantially similar height as the upper edge 35 of the functional unit 15. As illustrated in FIG. 9, the upper edge 110 of the panel 105 may be configured to support the water reservoir 25 during removal from and/or placement into the component housing unit 30. In various embodiments, the upper edge 110 of the panel 105 may include a protective guard (e.g., a coating, sleeve, or attachment having non-abrasive and/or elastic properties). In various implementations, the protective guard may protect or mitigate abrasive contact with the upper edge 110 and adjacent components and/or facilitate placement of the water reservoir 25. In various embodiments, the upper edge 110 of the panel 105 may be used as a guide to facilitate placement of the water reservoir 25 into the component housing unit 30.

Figure 10:
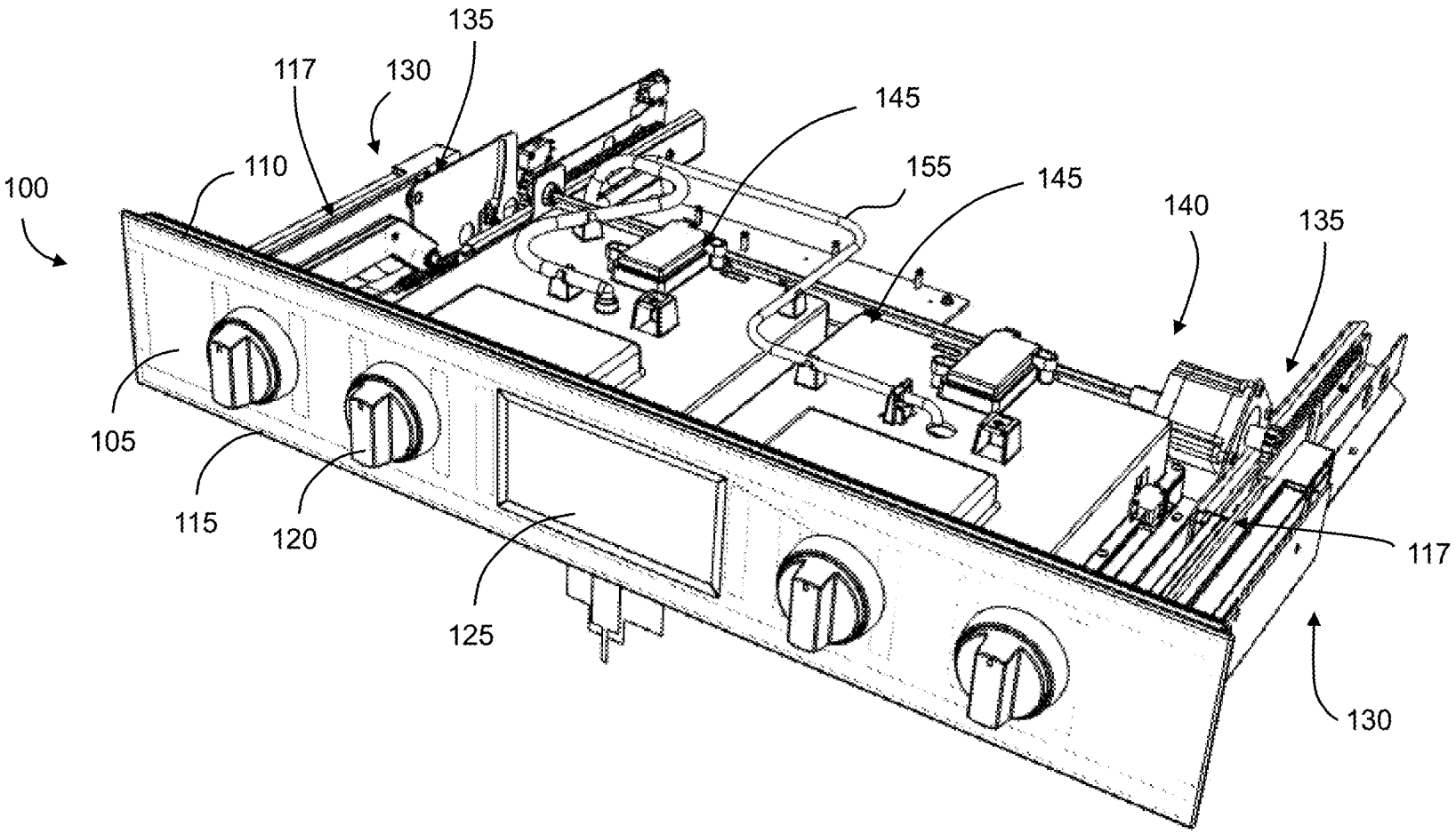
FIG. 10 is a perspective view of a movable panel assembly for the appliance of FIG. 1, according to an exemplary embodiment.
Figure 11:
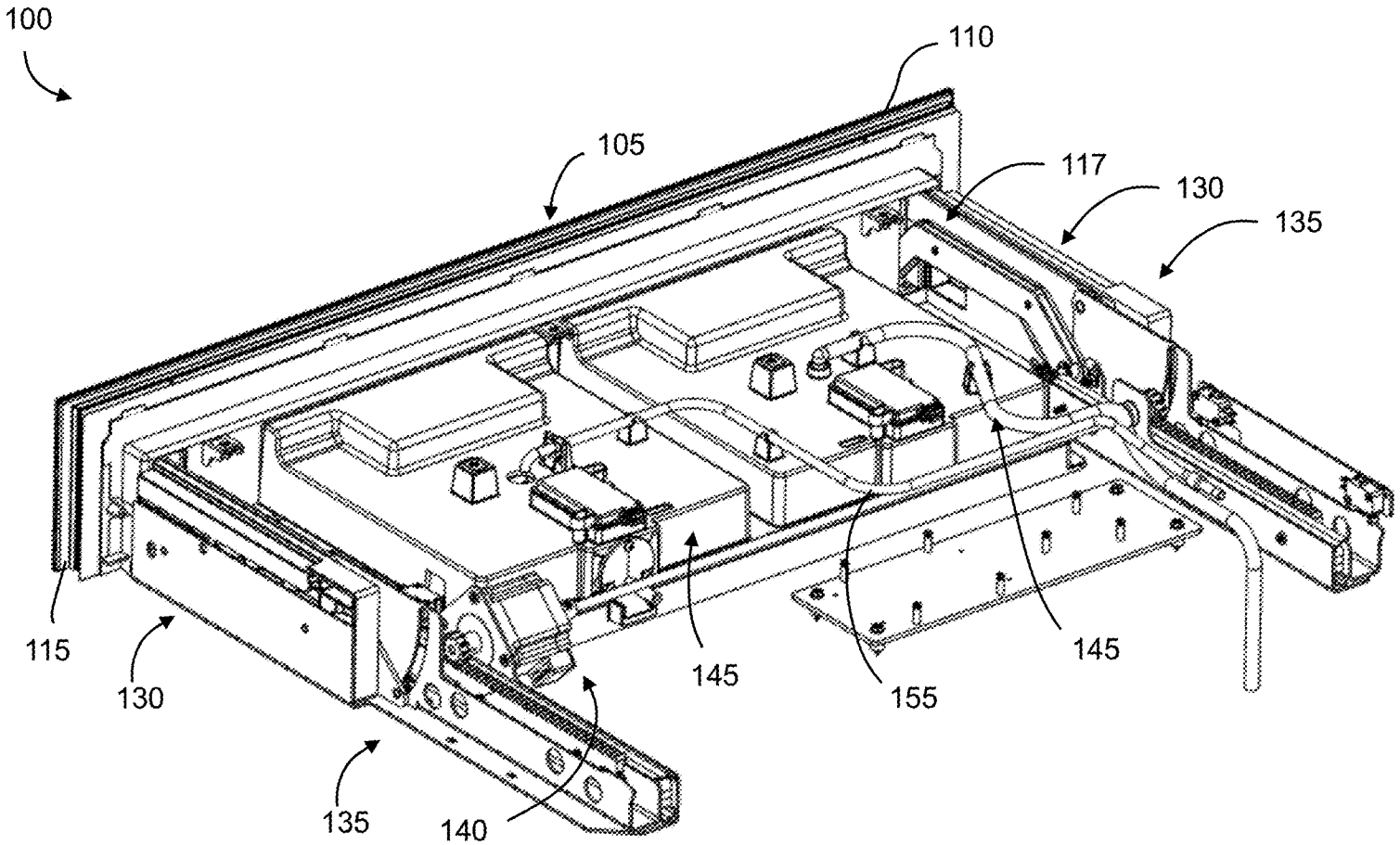
FIG. 11 is another perspective view of the movable panel of FIG. 9, according to an exemplary embodiment.

FIGS. 10 and 11 show front and rear perspective views, respectively, of the component housing unit 30 and the movable panel assembly 100 in a closed configuration, according to an exemplary embodiment. As shown, the panel 105 of the movable panel assembly 100 includes a user interface, which includes one or more controls 120 (e.g., knobs) and a graphical display 125. The controls 120 and/or the display 125 may be configured to control one or more operations of the appliance 10, functional units 15 and/or 20, component housing unit 30, and/or movable panel assembly 100. The movable panel assembly 100 further includes a cam mechanism 130 including the linkage components 117 configured as two parallel linkage portions 135 that are coupled to opposite sides of the component housing unit 30. Each of the linkage portions 135 within the cam mechanism 130 is actuated by a motor 140, which is disposed toward a rearward portion of the movable panel assembly 100. As illustrated, the motor 140 may be disposed behind enclosures 145, which are configured to house water reservoirs 25 therein. Accordingly, the motor 140 may be a stationary motor such that the enclosures 145 and associated waterway connections 155 remain undisturbed during operation of the motor 140. Furthermore, as illustrated, when the assembly 100 is in the closed configuration, the panel 105 is disposed in front of enclosures 145, preventing access thereto. In various embodiments, the movable panel assembly 100 may alternatively include a motor and timing shaft configured to displace during operation of the movable assembly 100.

Figure 12:
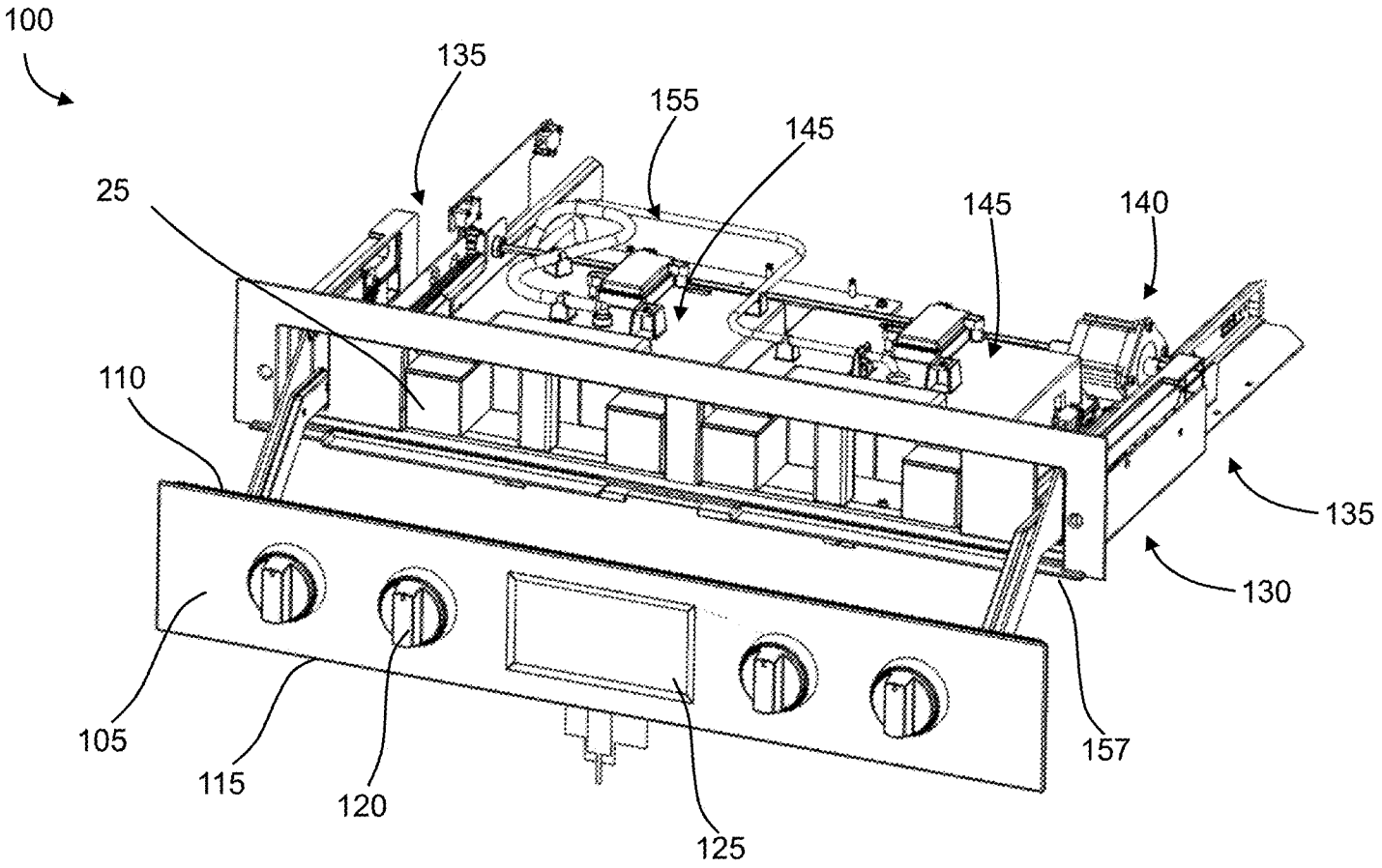
FIG. 12 is perspective view of the water reservoir assembly and the movable panel assembly for the appliance of FIG. 1 in an open configuration, according to an exemplary embodiment.
Figure 13:
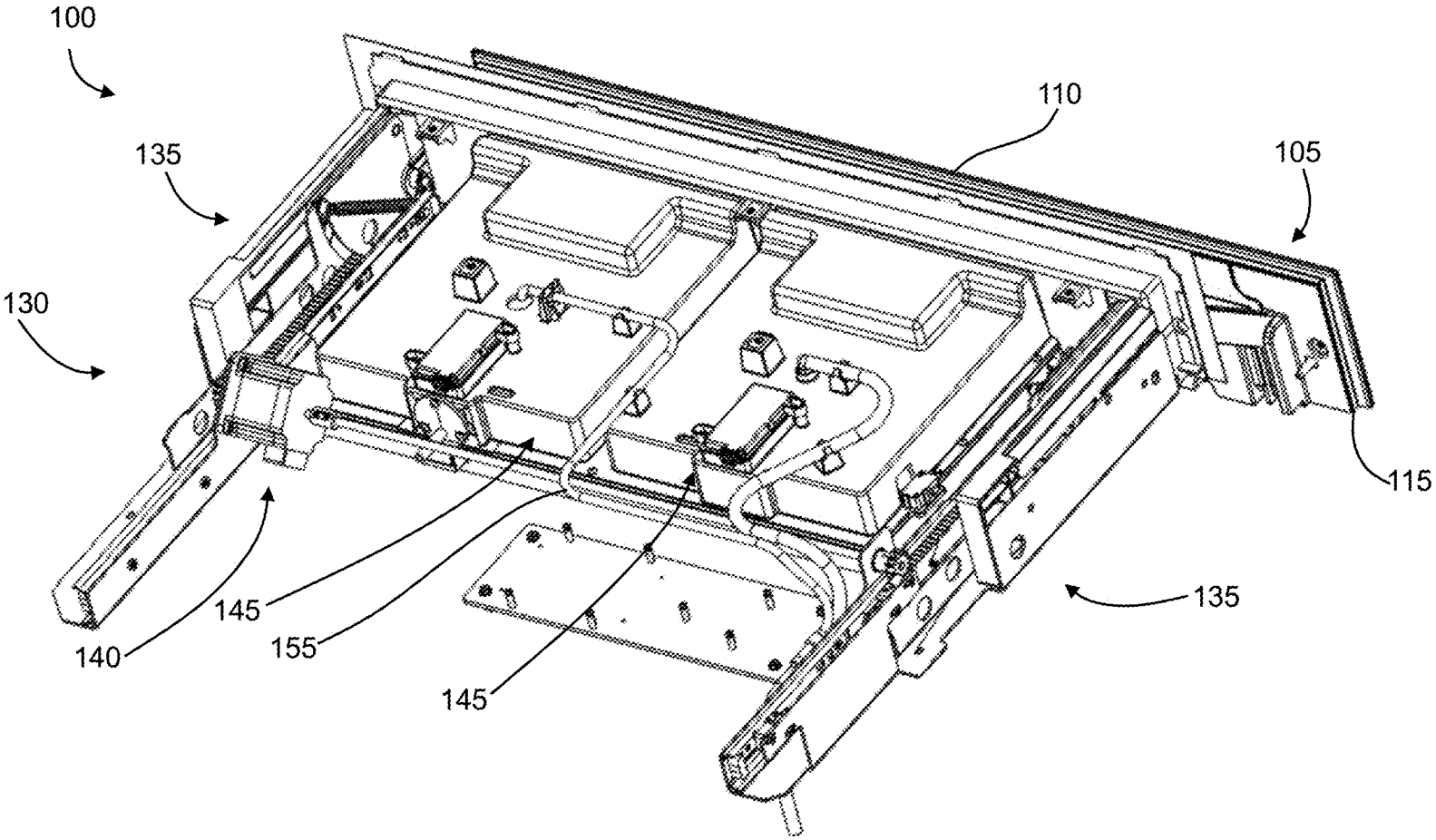
FIG. 13 is another perspective view of the water reservoir assembly and the movable panel assembly of FIG. 11, according to an exemplary embodiment.

FIGS. 12 and 13 show front and rear perspective views of the component housing unit 30 and the movable panel assembly 100 in an open configuration, according to an exemplary embodiment. As shown, when the movable panel assembly 100 is in the open configuration, the panel 105 is horizontally and vertically displaced relative to the component housing unit 30. Accordingly, the displacement of the panel 105 enables access to the water reservoirs 25 contained within enclosures 145. In various embodiments, the panel 105 may be displaced such the upper edge 110 of the panel 105 may be at the same height or a substantially similar height as a bottom edge 157 of the component housing unit 30. In other embodiments, as previously described, the panel 105 may be displaced such that the upper edge 110 may be at the same height or a substantially similar height as the upper edge 35 of the functional unit 15.

Figure 14:
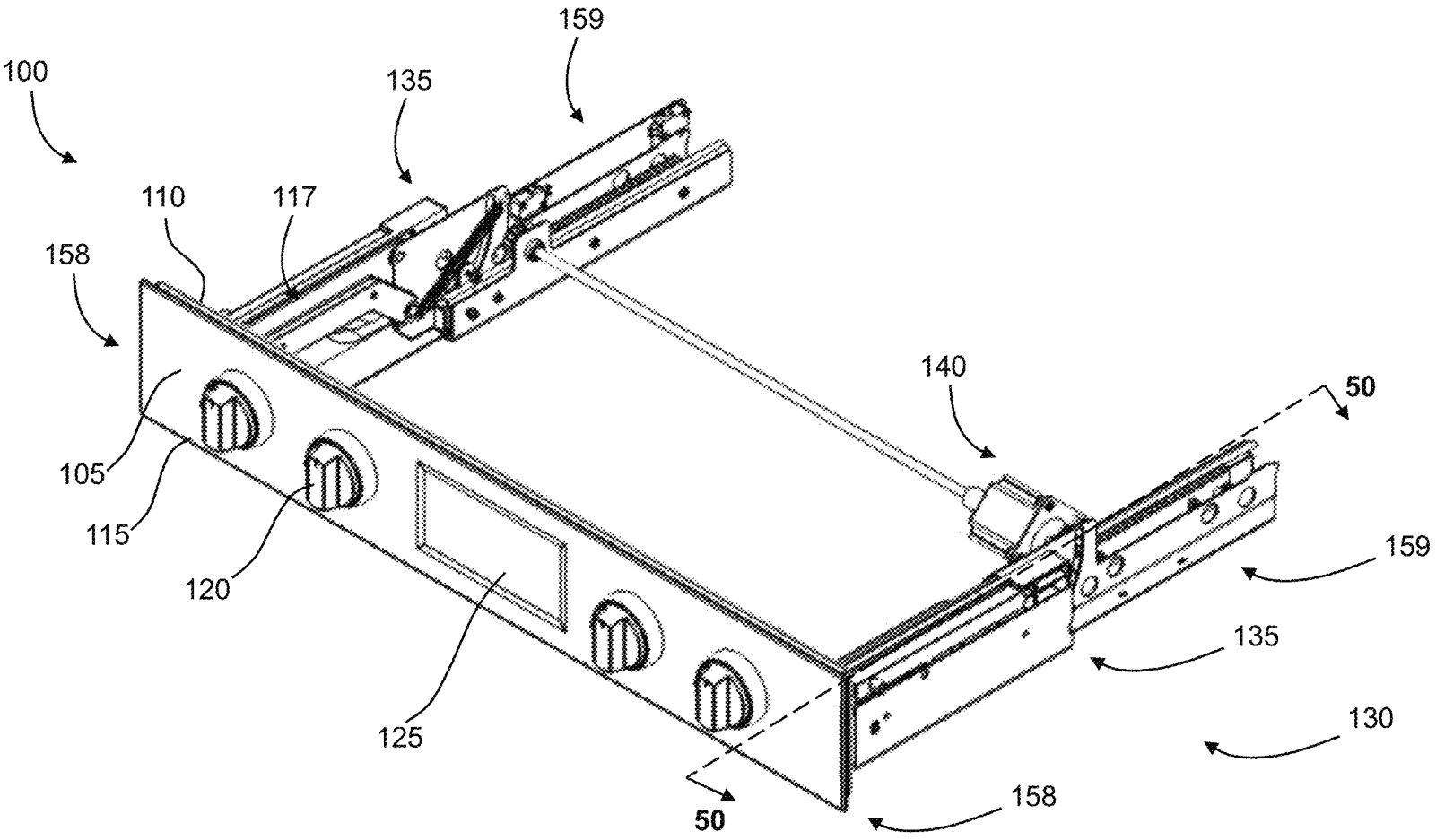
FIG. 14 is perspective view of a movable panel assembly, according to an exemplary embodiment.
Figure 15:
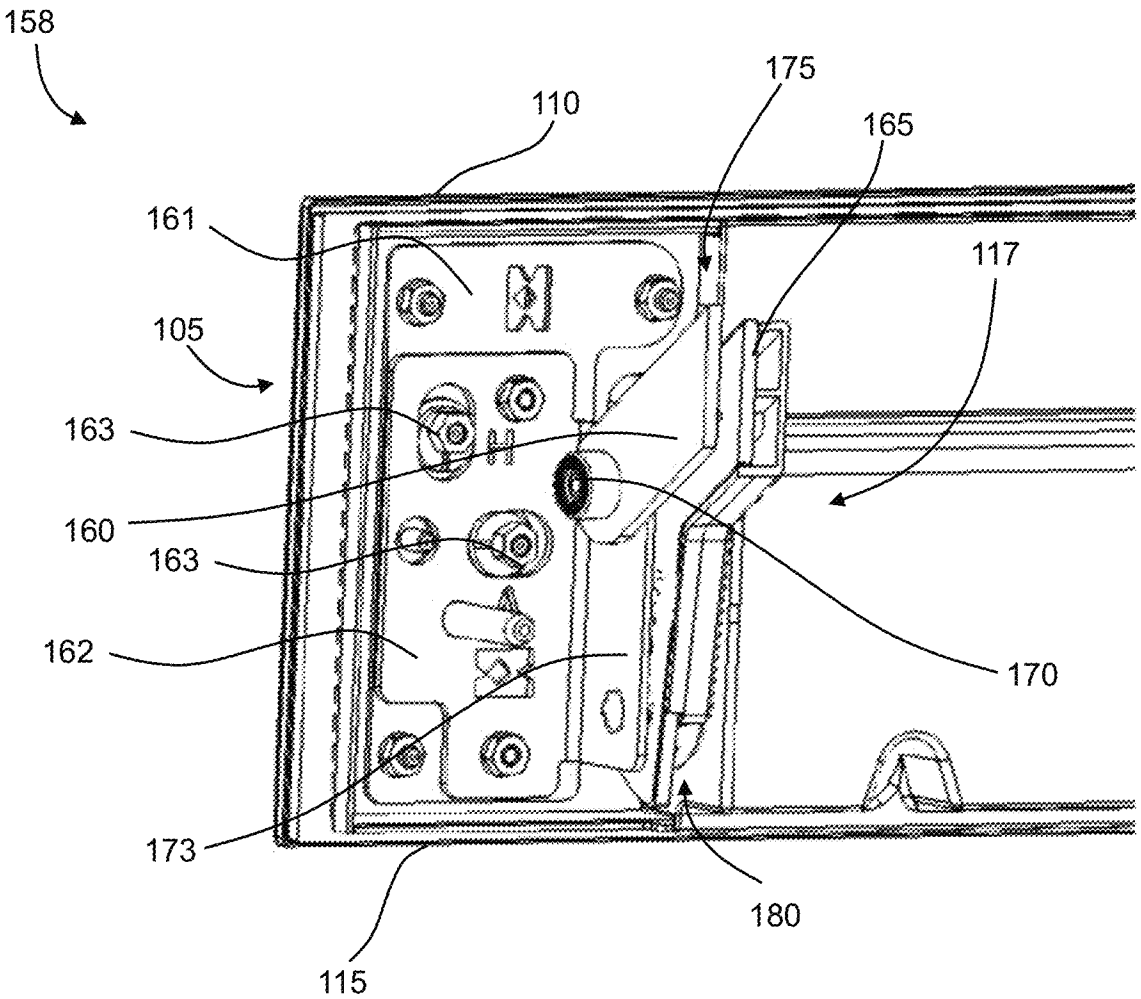
FIG. 15 is a back perspective view of the movable panel assembly of FIG. 14 near the panel, according to an exemplary embodiment.

FIG. 14 shows a perspective view of the movable panel assembly 100, according to an exemplary embodiment. As described previously, the linkage portions 135 within the cam mechanism 130 are connected to the panel 105 and the component housing unit 130. As illustrated, the linkage portions 135 may be coupled to the panel 105 at ends 158 and may be configured for coupling to the component housing unit 30 at ends 159. As shown in FIG. 15, which illustrates end 158, the linkage portions 135 may include linkages 160 and 165. The linkages 160 and 165 may be coupled to a one or more adjustment plates 161 and 162, which are further coupled to a bracket 173 of the panel 105 via fasteners 170 and 180, at a joint 175. As shown, the adjustment plates 161 and 162 may include one or more eccentric cams 163, which may be adjusted (e.g., by rotating to push on plates 161 and/or 162) to change an angular rotation and/or vertical position of the panel 105 relative to the component housing unit 30. In various embodiments, the rotation of the panel 105 may enable a user to access or view one or more controls disposed on the panel 105 (e.g., controls 120, display 125, etc.). In various embodiments, the eccentric cams 163 may include one or more indicators (e.g., visual indicia) to indicate a degree or extent of adjustment of the panel 105 In various embodiments, the panel 105 may be adjustable at joint 175 (e.g., via fastener 170) to enable rotation of the panel 105 relative to the linkage portions 135 and/or the appliance 10. In various embodiments, the one or more adjustment plates 161 and 162 may be adjusted to account for tolerance stack-up (e.g., from manufacture and/or installation), compensate for non-square or out of plumb conditions during installation, and/or variance in assembly (i.e., of the movable panel assembly 100).

Figure 16:
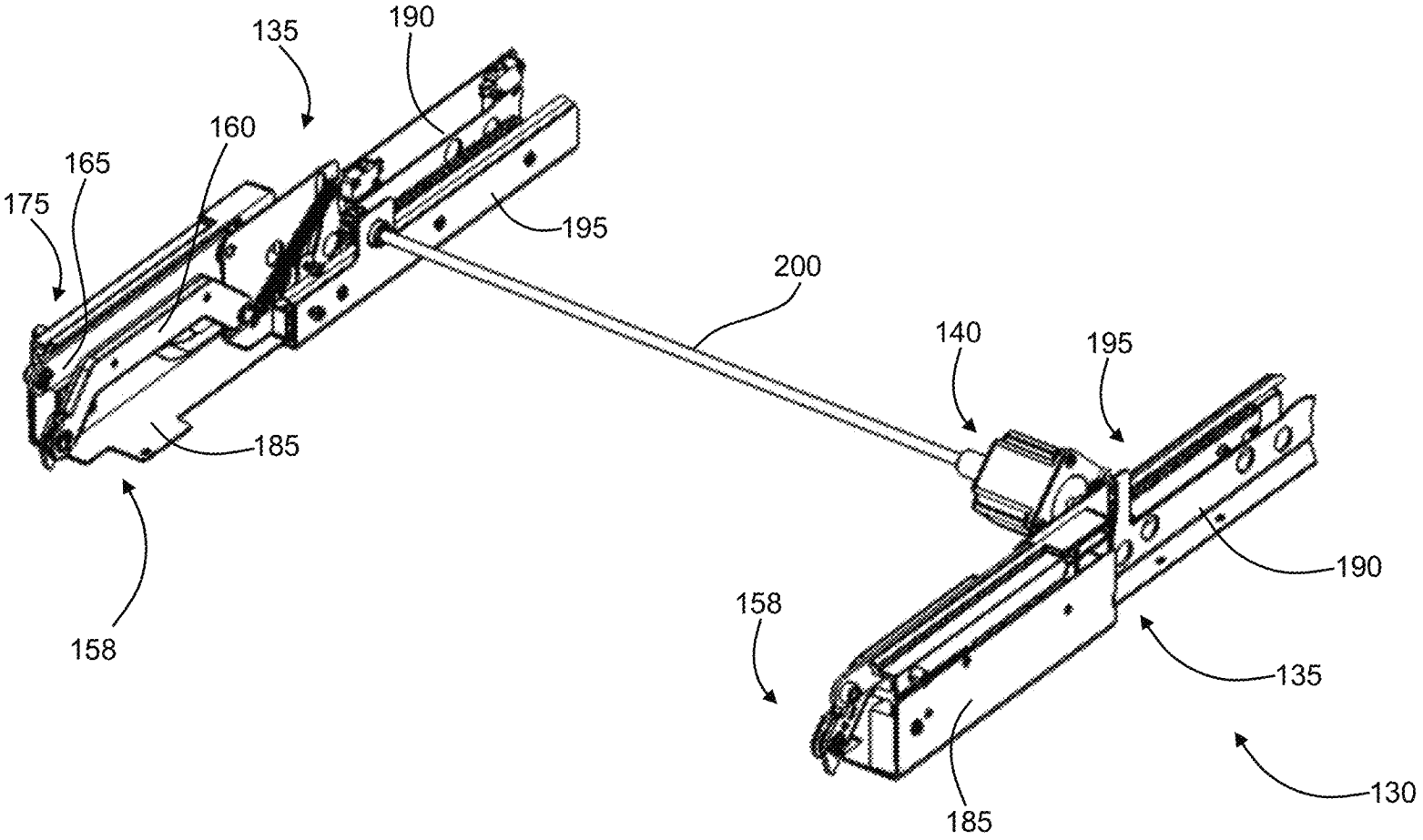
FIG. 16 is a perspective view of linkage portions within the cam mechanism of the movable panel assembly of FIG. 14, according to an exemplary embodiment.

FIG. 16 shows a perspective view of the linkage portions 135 of the cam assembly 130 movable panel assembly 100, according to an exemplary embodiment. As shown, the two parallel linkage portions 135 include cam plate 185 and slidable rail 190 (e.g., drawer slide), which are configured to be coupled to the component housing unit 30. Within each of the linkage portions 135, the slidable rail 190 may be configured to house a gear mechanism 195, which is driven by the stationary motor 140. As shown, the stationary motor 140 is disposed adjacent one of the linkage portions 135 and coupled to both of the linkage portions 135 via a timing shaft 200, which is configured to maintain coordinated and simultaneous actuation of the gear mechanisms 195 within each respective linkage portion 135.

Figure 17:
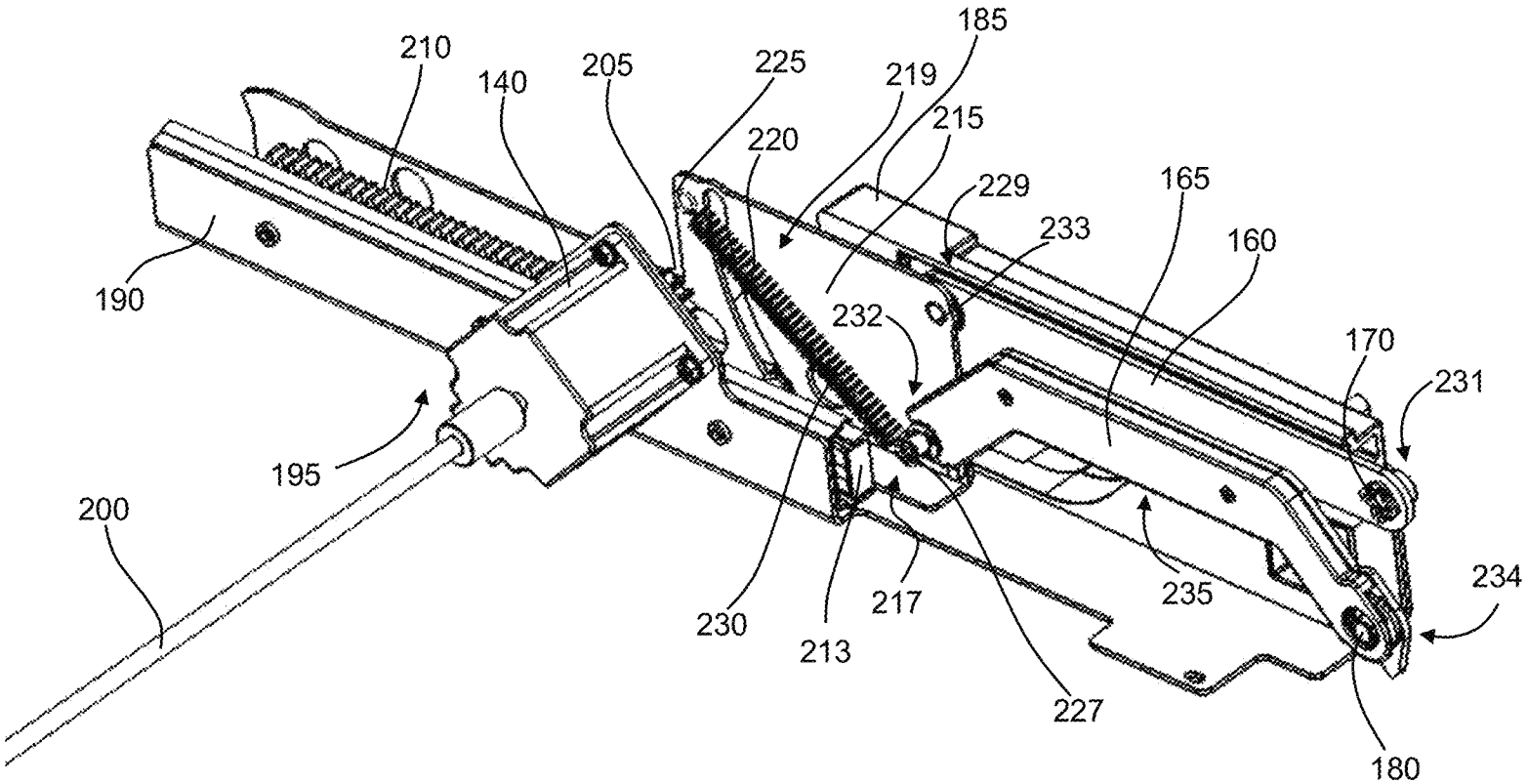
FIG. 17 is a side perspective view of the linkage portions within the cam assembly of FIG. 16 near a motor, according to an exemplary embodiment.
Figure 18:
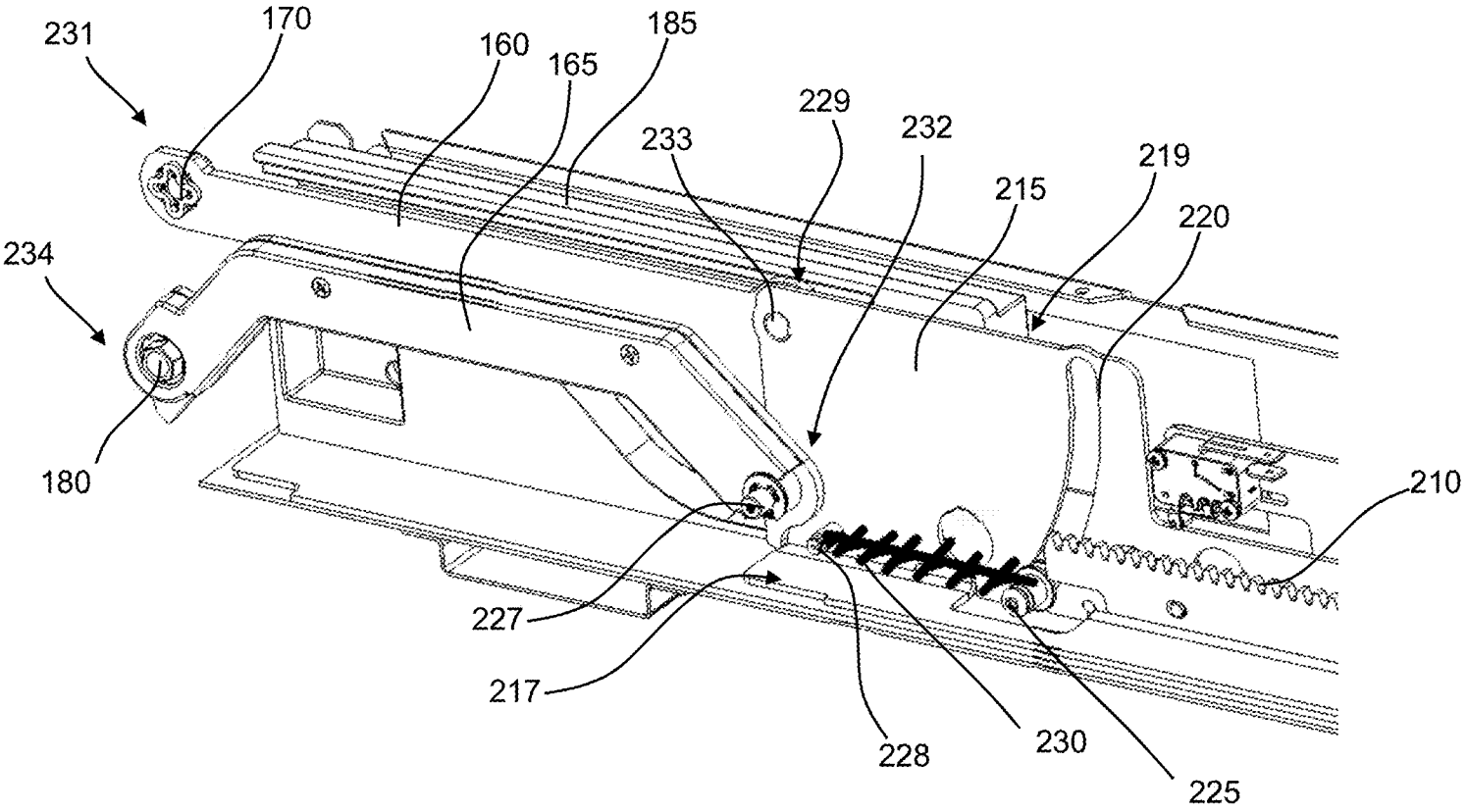
FIG. 18 is an alternate side perspective view of the linkage portions within the cam assembly of FIG. 16 near the spring, according to an exemplary embodiment.
Figure 19:
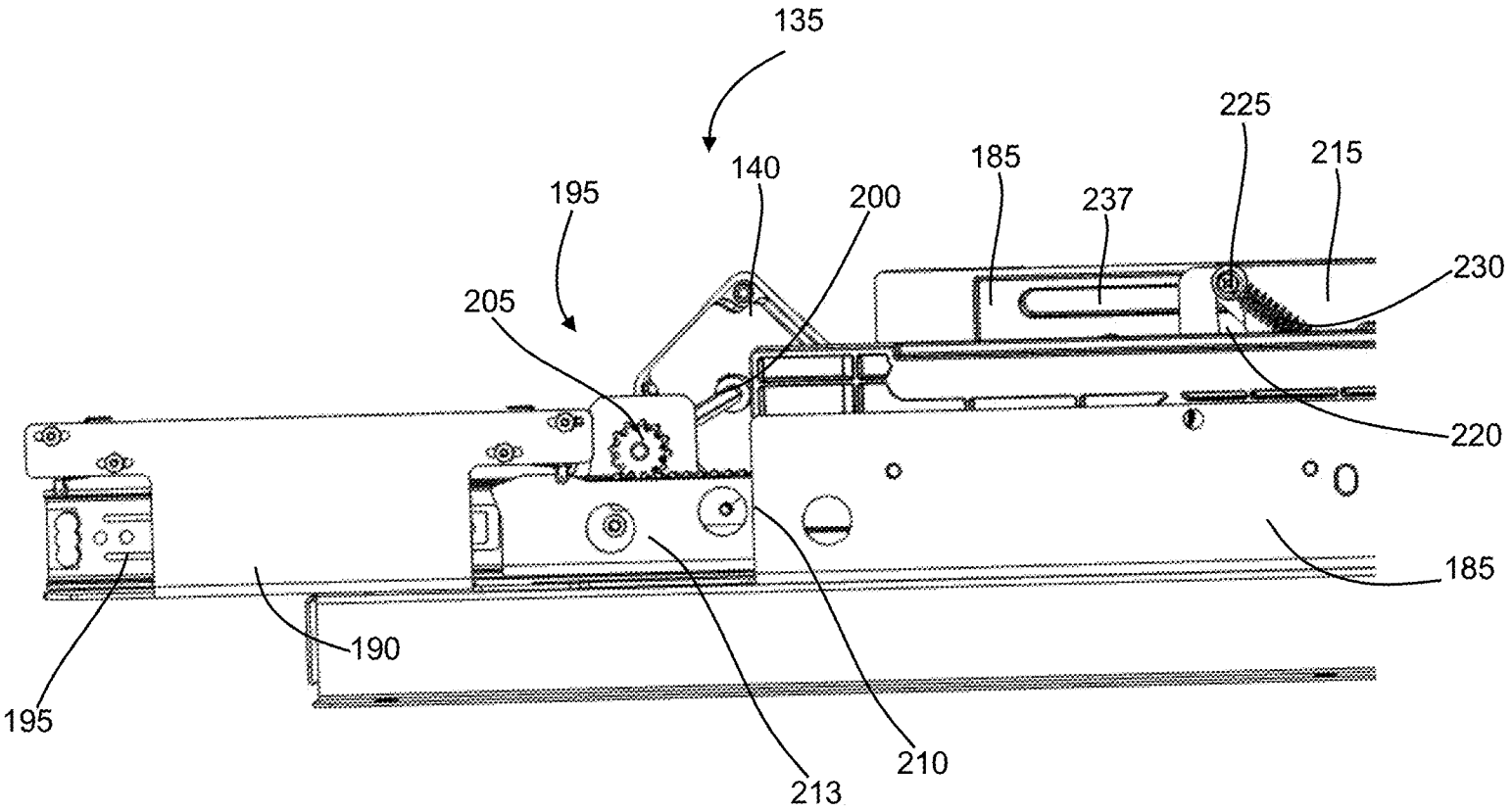
FIG. 19 is another side perspective view of the linkage portions within the cam assembly of FIG. 14, according to an exemplary embodiment.

As illustrated in FIGS. 17-18, the gear mechanism 195 (within each linkage portion 135) includes a gear 205, which is configured to articulate with a rack 210. The rack 210 may be coupled to a sliding portion 213 within the slidable rail 190 such that rotation of the gear 205 as it articulates with the rack 210 causes translation of the sliding portion 213 relative to the slidable rail 190. An end of the sliding portion 213 may be coupled to an angled plate 215 at a horizontal portion 217, wherein the angled plate 215 includes the horizontal portion 217 and a vertical portion 219. As shown, the vertical portion 219 of the angled plate 215 includes a curved channel 220. The curved channel 220 is configured to have a length and/or degree of curvature to facilitate movement of the panel 105 such that the panel 105 both clears potential obstacles disposed on a front portion of the appliance 10 (e.g., handle 40) and also maintains a close proximity to the obstacles (e.g., handle 40). Accordingly, one or more sensors, which may be communicatively coupled to a controller and/or the motor 140, may be coupled to the panel 105 (or one or more components coupled thereto). The one or more sensors may detect a proximity of the panel 105 to the obstacle (e.g., handle 40), wherein the controller may then determine whether the movable panel assembly 100 is in an open (i.e., the one or more sensors detect the obstacle) or a closed (i.e., the one or more sensors do not detect the obstacle) configuration. A first pin 225 (e.g., bearing, sliding roller), which is directly or indirectly coupled to a spring 230 extending from the first pin 225 to a second pin 228, is configured to translate within the curved channel 220 as the sliding portion 213 moves responsive to actuation by the motor 140. In various embodiments, the spring 230 is configured to provide resistance to the first pin 225 to facilitate control of a speed at which the first pin 225 translates within the channel 220, wherein a stiffness of the spring 230 is sufficient to offset the weight of the movable panel assembly 100 such that the first pin 225 contacts the curved channel 220 within the angled plate 215 at all times. FIG. 17 shows the spring 230 in a deflected (i.e. extended) state and FIG. 18 shows the spring 230 in a non-deflected (i.e. contracted) state.

As illustrated, each of the linkage portions 135 includes links 160 and 165, which may be configured to act as cam followers within the cam mechanism 130 of the movable panel assembly 100. Inclusion of both links 160 and 165 enable maintain a vertical orientation of the panel 105 as the movable panel assembly transitions between open and closed configurations. As shown, link 160, which is disposed closest to the cam plate 185 and adjacent a first side of the angled plate 215, is coupled to the vertical portion 219 of the angled plate 215 at a joint via pin 233 at a first end 229. The link 160 is further configured for coupling to the panel 105 via fastener 170 at a second end 231. As shown, link 165 is disposed adjacent a second side of the angled plate 215 opposite the first side and the link 160. The link 165 is coupled to the angled plate 215 at a first end 232 via the joint 227. The link is further configured for coupling to the panel 105 via fastener 180 at a second end 234. As illustrated, the link 165 includes an elevated portion 235, which includes a horizontal section of the link disposed between the first end 232 and the second end 234. As shown, the elevated portion 235 has a height higher than a height of each end 232 and 234 such that the link 165 does not contact the bottom edge 157 of the component housing unit 30 during translation.

Figure 20:
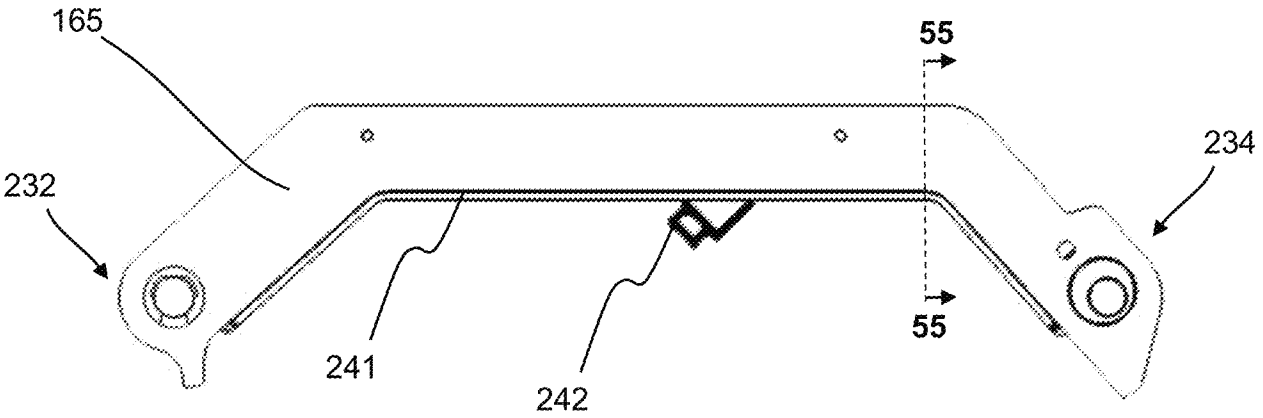
FIG. 20 is a side view of a link within the cam assembly, according to an exemplary embodiment.
Figure 21:
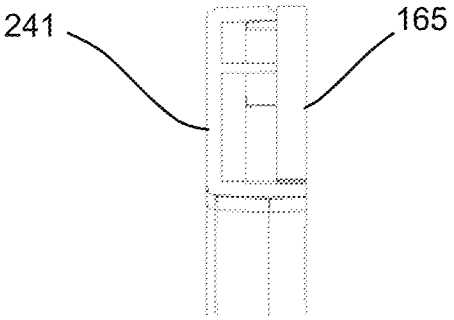
FIG. 21 is an end cross-sectional view of the link of FIG. 20, taken along line 55-55 of FIG. 20, according to an exemplary embodiment.

In various embodiments, the links 160 and/or 165 may include one or more bumpers or guards disposed thereon to prevent abrasive contact with the upper edge 35 of the functional unit 15, the handle 40, and/or the bottom edge 157 of the component housing unit 30. FIG. 20 shows a side view of the link 165 with a coupled guard or cover 241, according to an exemplary embodiment. As shown, the cover 241 may be coupled to the link 165 such that the cover 241 extends along a bottom surface of the link 165 to prevent abrasive contact between the bottom surface of the link 165 and one or more surfaces within the appliance 10 (e.g., upper edge 35, handle 40, bottom edge 157). As shown in FIG. 21, which shows a section view of the link 165 taken along line 55-55 of FIG. 20, the cover 241 may be configured to wrap around a side of the link 165 in addition to the bottom surface of the link 165. Additionally or alternatively, the link 165 may include a bumper 242 disposed on the bottom surface of the link 165. In various embodiments, the bumper 242 may be integrally formed with the link 165 or may be separately formed and coupled to the link 165. In some embodiments, the bumper 242 may be coupled to or integrally formed with the cover 241. In various embodiments, the cover 241 and/or the bumper 242 may consist of or comprise one or more thermoplastics.

FIGS. 22-25 show alternate cross-sectional views, taken along line 50-50 of FIG. 14, of the movable panel assembly 100 coupled within the component housing unit 30 of the appliance 10 in various stages of operation, according to various exemplary embodiments. As illustrated in the figures, link 160 is coupled to the pin 233, which is disposed within a first portion 238 of the link 160 and is configured to articulate within a channel 237 of the cam plate 185. As shown, the channel 237 may be disposed within a protruding portion 239 of the cam plate 185. In various embodiments, the protruding portion 239 may be integrally formed or coupled to the cam plate 185. The link 160 is also coupled to a pin 250 (e.g., a bearing), which is disposed within a second portion 253 of the link 160 and is configured to articulate within a channel 240 disposed within the cam plate 185.

As previously described, the link 160 is coupled to the angled plate 215 via the pin 233. Accordingly, as the angled plate 215 is translated with the sliding portion 213 (responsive to actuation by the motor 140 and rotation of the gear 205), the pin 233 is displaced within the channel 237. As the pin 233 is displaced within the channel 237, the pin 250 is similarly displaced within the channel 240. Thus, as the sliding portion 213 translates responsive to actuation by the motor 140, the link 160 is translated relative to the component housing unit 30.

Figure 22:
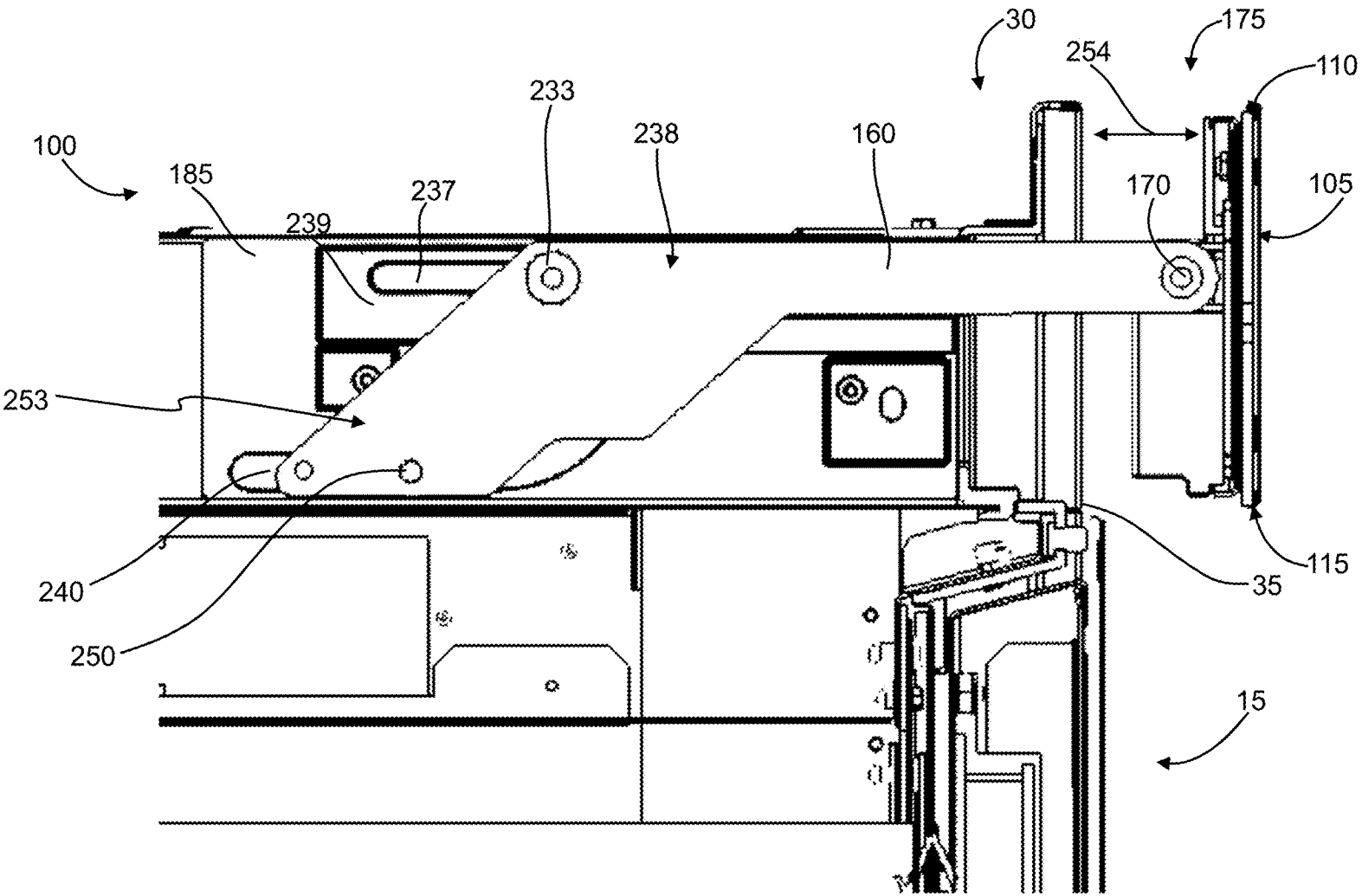
FIG. 22 is a side cross-sectional view of a movable panel assembly within an appliance illustrating the panel assembly in a near closed configuration, taken along line 50-50 of FIG. 14, according to an exemplary embodiment.
Figure 23:
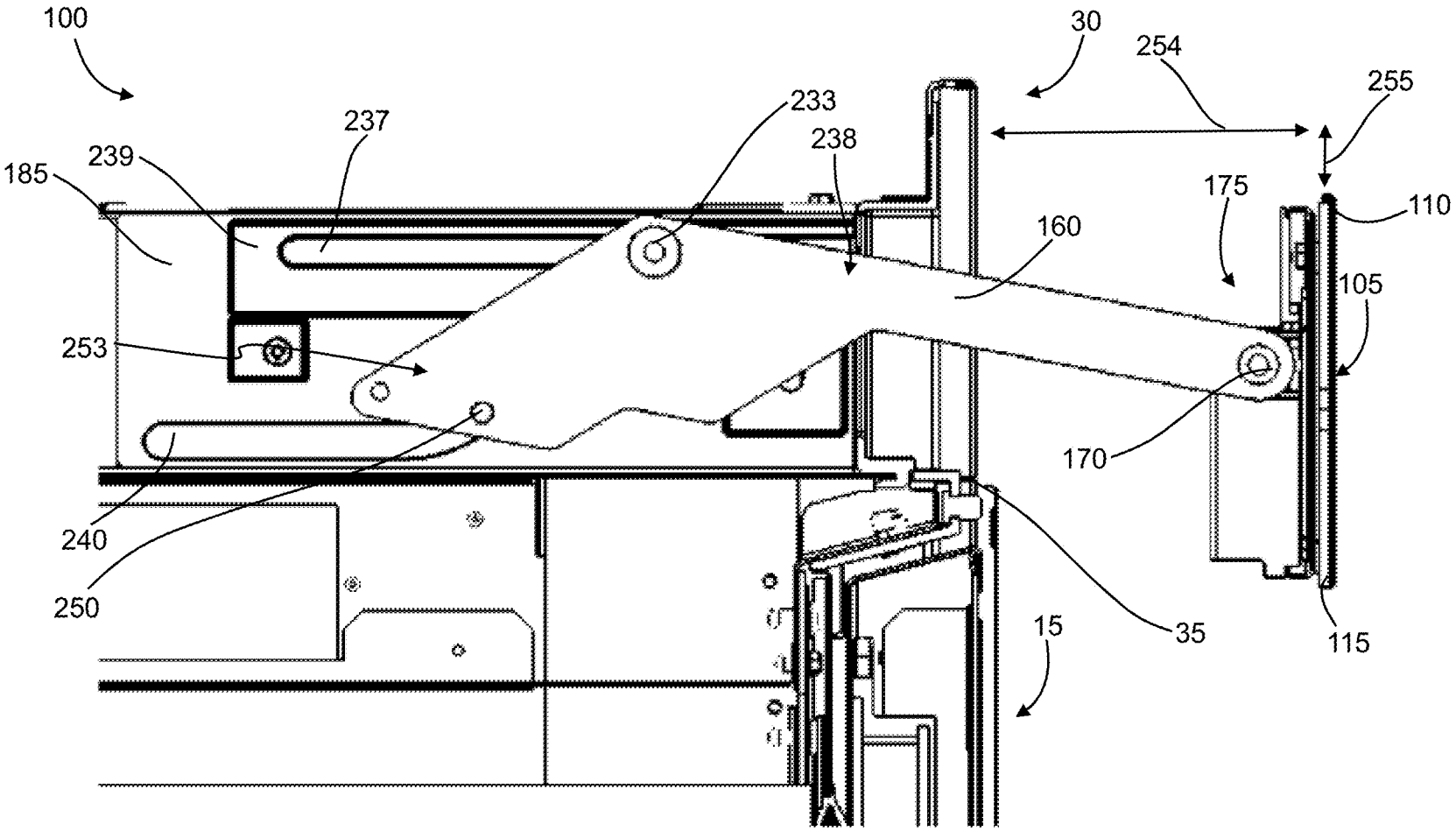
FIG. 23 is a side cross-sectional view of the movable panel assembly in an intermediate configuration, taken along line 50-50 of FIG. 14 according to an exemplary embodiment.
Figure 24:
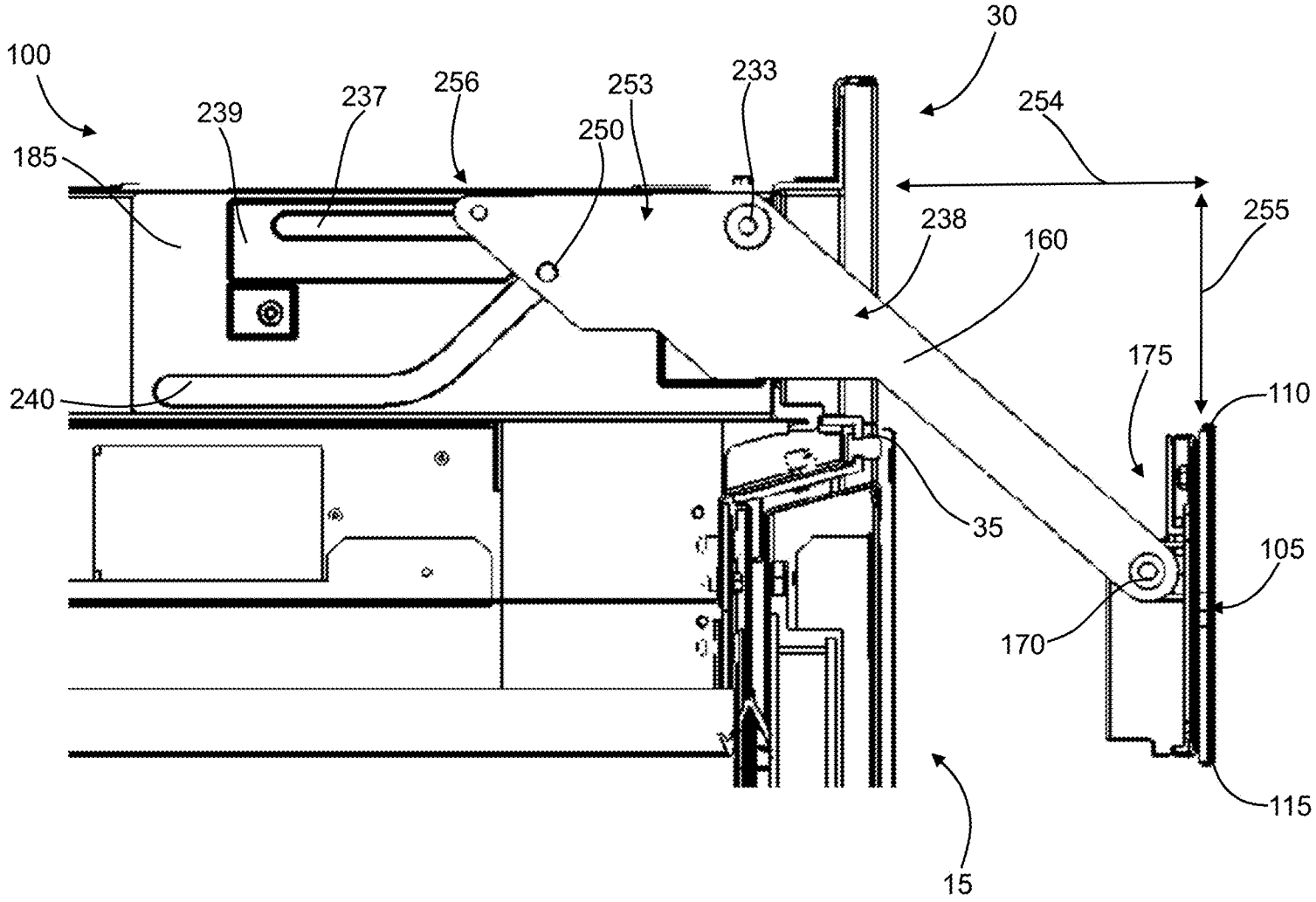
FIG. 24 is a side cross-sectional view of the movable panel assembly in an open configuration, taken along line 50-50 of FIG. 14, according to an exemplary embodiment.
Figure 25:
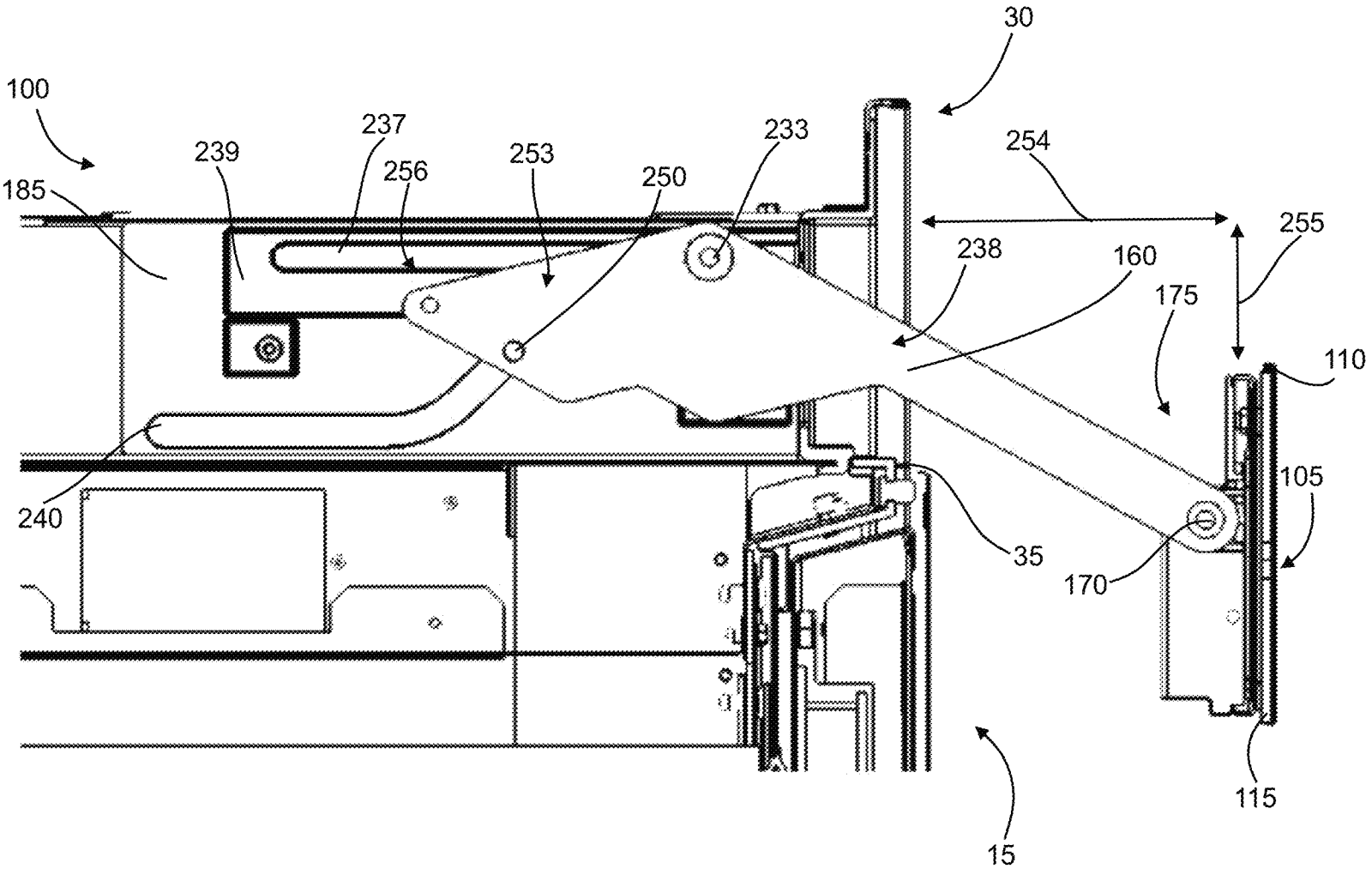
FIG. 25 is a side cross-sectional view of the movable panel assembly in another intermediate configuration, taken along line 50-50 of FIG. 14, according to an exemplary embodiment.

FIG. 22 shows the movable panel assembly 100 in a nearly closed configuration, wherein the link 160 has been translated such that the panel 105 is a horizontal distance 254 from the component housing unit 30. As the motor 140 continues to rotate the gears 205 and thus displace the angled plate 215 within each respective linkage portion 135, the link 160 is further translated to an intermediate configuration, as illustrated in FIG. 23. As shown in FIG. 23, the pins 233 and 250 translate within channels 237 and 240, respectively, such that the link 160 is correspondingly translated in both horizontal and vertical directions 254 and 255, respectively. As shown, pin 250, and thus second portion 253, is configured to follow the pin 233 within the first portion 238 of the link 160 as link 160 translated. Accordingly, the second portion 253 is configured to pivot responsive to displacement of the pin 250 within the channel 240. Finally, as shown in FIG. 24, the movable panel assembly 100 may reach a maximally open configuration where horizontal and vertical distances 254 and 255, respectively, of the panel 105 relative to the component housing unit 30, are maximized. As shown in FIG. 24, when the movable panel assembly 100 is in the open configuration, a terminal end 256 within the second portion 253 of the link 160 is disposed at a substantially same or similar height as a height of the pinon 233 within the channel 237. In various embodiments, after the movable control assembly 100 has been maximally opened, the motor 140 may be configured to drive the gear 205 in a reverse direction, causing the slidable portion 213, coupled angled plate 215, and the link 160 to be translated in a direction toward the component housing unit 30, thereby returning the assembly 100 to a closed configuration. Accordingly, as illustrated in FIG. 25, the pins 233 and 250 may be translated again through the channels 237 and 240, respectively, such that the end 256 of the link 160 pivots downward relative to the pin 233 as the assembly 100 returns to the closed configuration.

Figure 26:
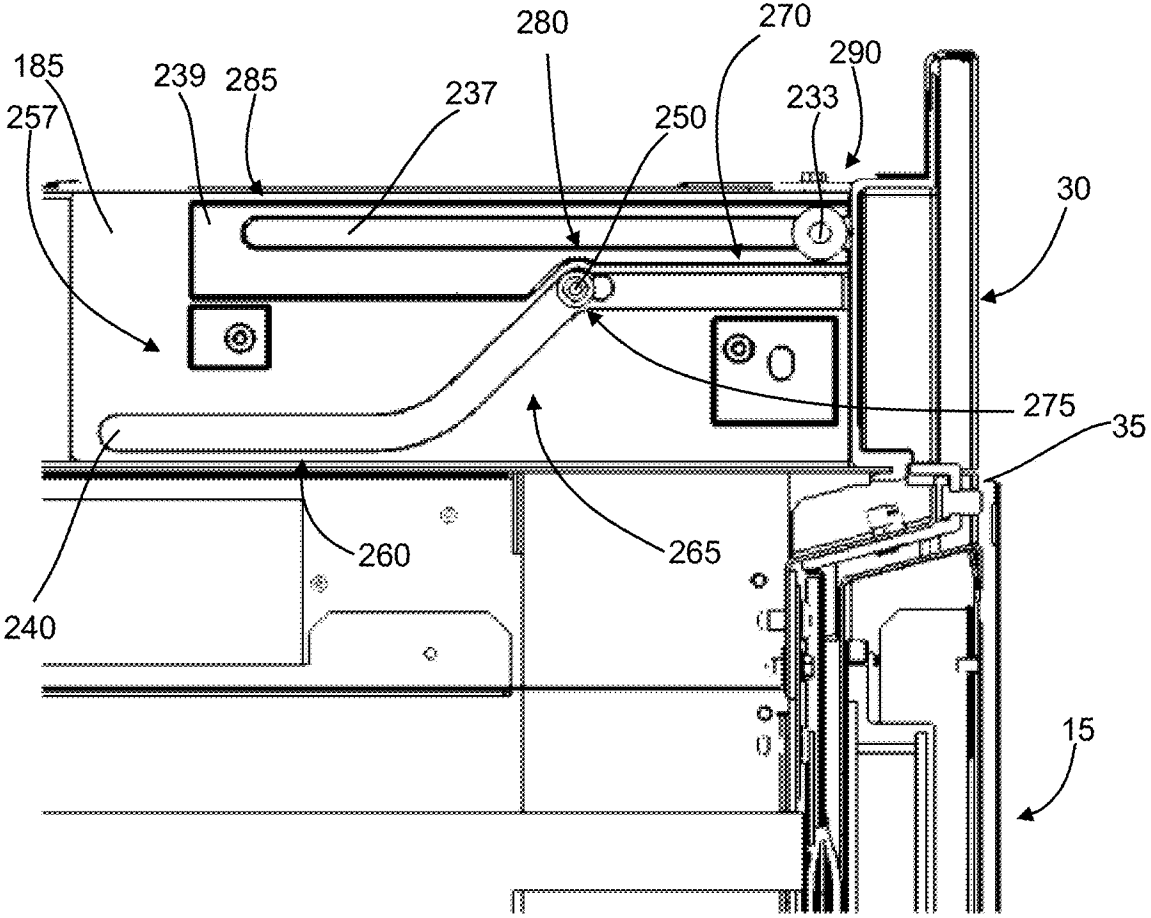
FIG. 26 is a side cross-sectional view of the movable panel assembly in an open configuration and with link 160 removed, taken along line 50-50 of FIG. 14, according to an exemplary embodiment.
Figure 27:
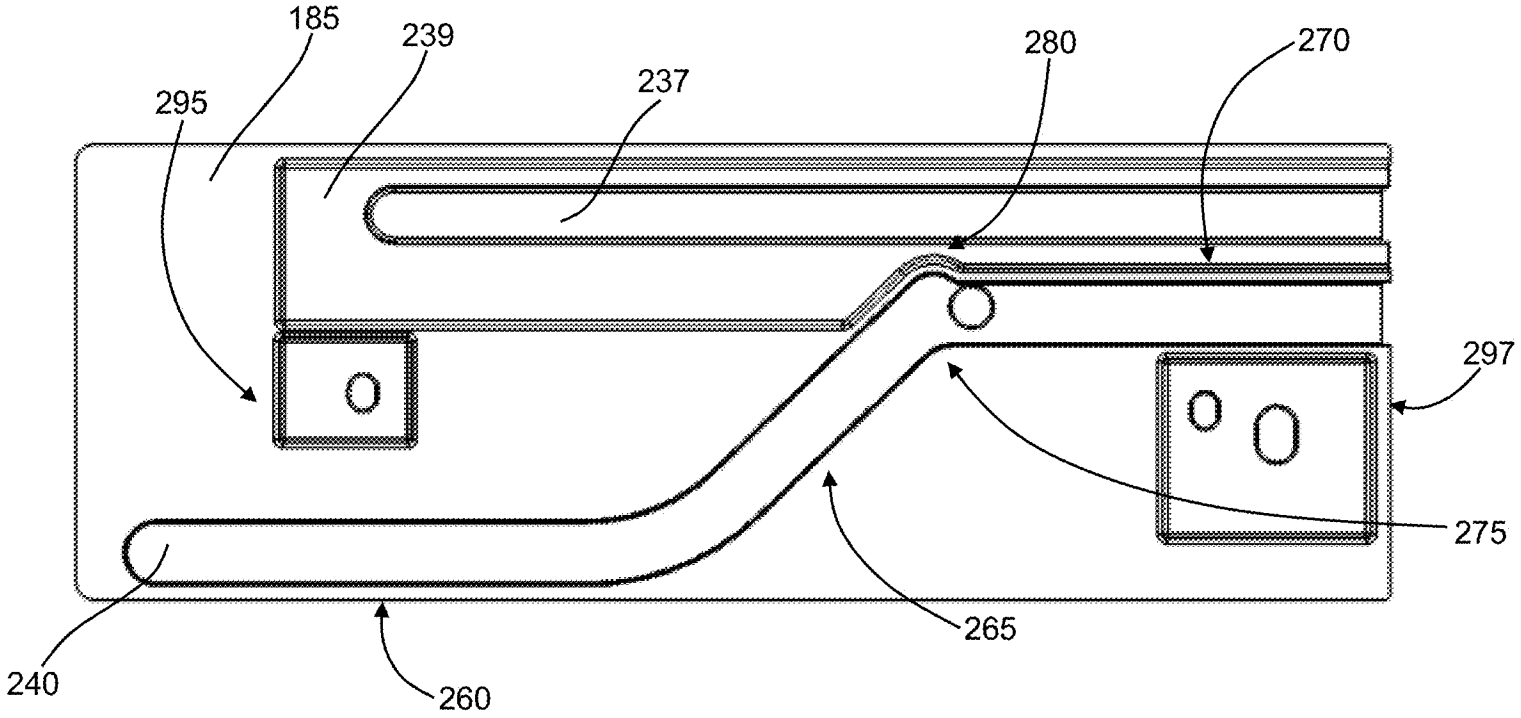
FIG. 27 is a side cross-sectional view of the movable panel near the cam mechanism, taken along line 50-50 of FIG. 14 according to an exemplary embodiment.

FIGS. 26 and 27 show a cross-sectional view of the movable panel assembly 100 with the link 160 removed, taken along line 50-50 of FIG. 14, according to an exemplary embodiment. As shown, the channel 237, within which the pin 233 translates, may be configured to be substantially linear and with no significant curvature or contoured portions. Conversely, the channel 240, within which the pin 250 translates, may be configured to include a first linear portion 265, an inclined portion 265, and a second linear portion 270. A length and/or gradient of the inclined portion 265 may be optimized to both facilitate smooth translation of components within the movable panel assembly 100 and enable manual operation of the movable panel assembly 100 (i.e., without actuation from the motor 140). As illustrated in the figures, the pin 233 is configured to translate the length of the channel 237—displacing from a first end 285 of the channel 237 to a second end 290 of the channel 237—when the linkage portion 135, and thus link 160, is actuated by the motor 140. Similarly, the pin 250 is configured to translate through the first linear portion 260 and the inclined portion 265 of the channel 240 when the linkage portion 135, and thus link 160, is actuated by the motor 140. When the movable panel assembly 100 is in the open configuration, pin 250 may be disposed at a position 275 within the channel 240, which is located at an end of the inclined portion 265. In various embodiments, and as shown in FIG. 27, the cam plate 185 may include one or more features 295 and 297, which may be configured to facilitate coupling of the movable panel assembly 100 to the component housing unit 30.

In various embodiments, the channel 240 may include one or more features disposed at the position 275 to prevent further translation of the pin 250 therein. In various embodiments, the protruding portion 239 within the cam plate 185 may be configured to include one or more contours to complement one or more portions of the channel 240. As shown in FIG. 26, the protruding portion 239 may include a feature 280 (e.g., recess, detent), which corresponds to the position 275—located at the transition between the inclined portion 265 and the second linear portion 270 of the channel 240. In various embodiments, the feature 280 is configured to enable the pin 250 to stop or rest within the channel 240 when the movable panel assembly 100 is in the open configuration. In various embodiments, during operation of the movable panel assembly 100, distances 253 and 254 of horizontal and vertical translation, respectively, of the panel 105 is determined by a length of the channels 237 and 240.

Figure 28:
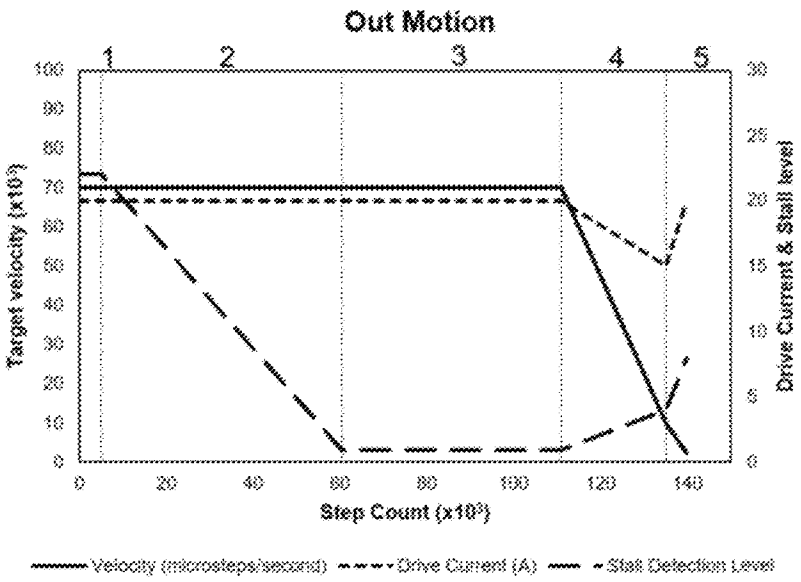
FIG. 28 is a graphical representation of motor speed, drive current, and stall detection of the motor during outward movement of the panel, according to an exemplary embodiment.
Figure 29:
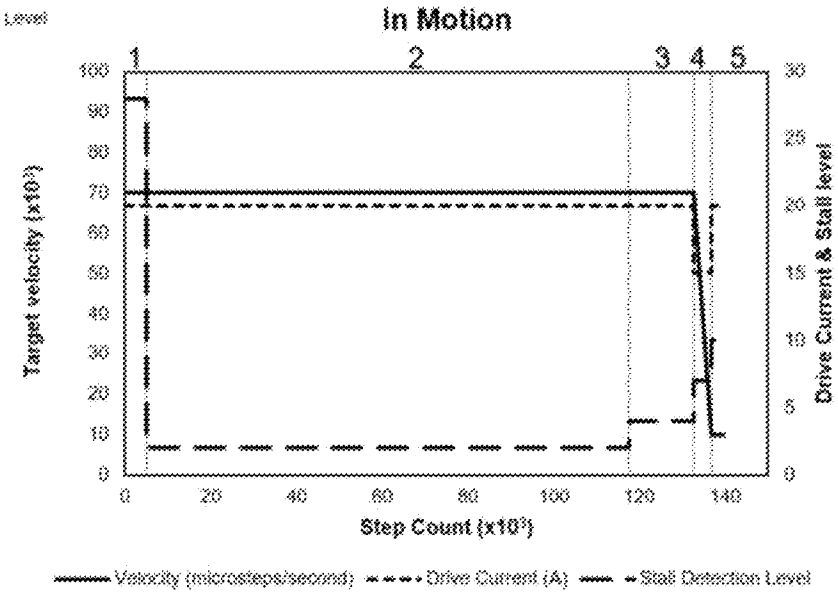
FIG. 29 is a graphical representation of motor speed, drive current, and stall detection of the motor during inward movement of the panel, according to an exemplary embodiment.

In various embodiments, the motor 140 may be configured to operate with one or more varying ramp rates and/or speeds such that the speed at which the panel 105 is displaced relative to the component housing unit 30 may vary as the movable panel assembly 100 progresses from the closed configuration to the open configuration. Varying ramp rates and/or the speed of the motor 140 as it displaces the panel 105 reduces overall operating time and facilitates smooth motion of the panel 105 and of components coupled thereto, thereby enhancing aesthetic appeal of the movable panel assembly 100. In addition, varying the ramp rate and/or speed of the motor 140 enables both lowering torque to reduce pinch risk (i.e., by reducing torque) to a user and allows dynamic torque increase to overcome static friction within the movable panel assembly 100. FIGS. 28 and 29 graphically illustrate how speed ("Velocity") of the motor 140 may vary as it causes the panel 105 to move outward to the open configuration and inward to the closed configuration. Operation of the motor 140 may include multiple phases as it displaces the panel 105 between open and closed configurations. In various embodiments, the motor 140 may maintain a constant velocity while the panel 105 is horizontally translating and may slow as the panel reaches a fully open and/or a fully closed position. In various embodiments, the motor 140 may be configured to vary a speed of actuation (e.g., of the gears 205) based on a positon of the pin 233 and/or pin 250 within respective channels 237 and 240. In various embodiments, the motor 140 may be configured to increase an applied torque to overcome friction and/or misalignments that might arise during final seating of components as the movable panel assembly 100 moves into an open configuration and/or returns to a closed configuration. Such increased torque may facilitate a slow, controlled stop of the panel 105 and other components as the movable panel assembly 100 returns to the closed configuration. In various embodiments, the motor 140 may be configured to increase a speed of operation (e.g., rpm) to cause the movable panel assembly 100 to enter the open configuration and/or return to the closed configuration within a preferred timeframe. In various embodiments, the motor 140 may be configured to reduce the applied torque based on a friction and/or impact threshold. Accordingly, the motor 140 may reduce the applied torque if one or more components in the movable panel assembly 100 encounters an obstacle, exceeds a threshold amount of friction, or exceeds a threshold torque during operation. For example, the motor 140 may decrease the applied torque or cease operation altogether if an object (e.g., user's finger) obstructs or is wedged between one or more components (e.g., pinched). In various embodiments, the motor 140 may be configured to vary the applied torque or operational speed to overcome or compensate for any mechanical noise (e.g., jitter, shimmy). In various embodiments, the motor 140 may be configured to adjust an acceleration/deceleration ramp rate to facilitate adjustment of operational speeds.

In various embodiments, the movable panel assembly 100 may be operably coupled to a controller, which may be configured to control the motor 140 and operate the assembly 100 to progress from a closed configuration to an open configuration and vice versa. In various embodiments, the controller may be configured to control the speed, acceleration, and/or applied torque of the motor 140. In various embodiments, the controller may be configured to control the speed and/or acceleration/deceleration ramp rate of the motor 140. The controller may be a non-transitory computer readable medium or processor, having computer-readable instructions stored thereon that, when executed, cause the controller to carry out the operations called for by the instructions. In various embodiments, the controller may be included within the appliance 10. In other embodiments, the controller may be remotely located relative to the appliance 10. In various embodiments, the ramp rate and/or speed of the motor 140 may be determined by the controller. In various embodiments, the controller, and thus the motor 140, may receive input from a user via the panel 105 (e.g., via controls 120 and/or display 125).

Notwithstanding the embodiments described above in FIGS. 1-29, various modifications and inclusions to those embodiments are contemplated and considered within the scope of the present disclosure.

It is also to be understood that the construction and arrangement of the elements of the systems and methods as shown in the representative embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed.

Accordingly, all such modifications are intended to be included within the scope of the present disclosure. Any means-plus-function clause is intended to cover the structures described herein as performing the recited function and not only structural equivalents but also equivalent structures. Other substitutions, modifications, changes, and omissions may be made in the design, operating conditions, and arrangement of the preferred and other illustrative embodiments without departing from scope of the present disclosure or from the scope of the appended claims.

Furthermore, functions and procedures described above may be performed by specialized equipment designed to perform the particular functions and procedures. The functions may also be performed by general-use equipment that executes commands related to the functions and procedures, or each function and procedure may be performed by a different piece of equipment with one piece of equipment serving as control or with a separate control device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Similarly, unless otherwise specified, the phrase "based on" should not be construed in a limiting manner and thus should be understood as "based at least in part on." Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent Moreover, although the figures show a specific order of method operations, the order of the operations may differ from what is depicted. Also, two or more operations may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection operations, processing operations, comparison operations, and decision operations.

The operations described in this specification can be implemented as operations performed by a data processing apparatus on data stored on one or more computer-readable storage devices or received from other sources. The term "data processing apparatus" or "computing device" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and an I/O device, e.g., a mouse or a touch sensitive screen, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTJVIL page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. In some cases, the actions recited herein can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A movable panel assembly, the assembly comprising:
a panel;
a cam mechanism coupled to the panel; and
a stationary motor operably coupled to the cam mechanism, such that the stationary motor causes operation of the cam mechanism;
wherein the cam mechanism comprises:
a rack mounted to a slidable rail, the rack configured to engage with a gear driven by the motor;
a plate rotatably coupled to the slidable rail, wherein the plate includes a curved first groove disposed therethrough;
a first cam follower, wherein a first end of the first cam follower is rotatably coupled to the plate on a first side of the plate, and a second end of the first cam follower is coupled to the panel; and
a second cam follower, wherein a first end of the second cam follower is A coupled to the plate on a second side of the plate, and a second end of the second cam follower is coupled to the panel;
wherein the second cam follower includes a first pin and a second pin, wherein the first and second pins are configured to respectively translate within first and second channels of a cam plate, the cam plate being coupled to a chassis of an appliance; and
wherein operation of the cam mechanism causes the panel to move relative to the chassis.

2. The movable panel assembly of claim 1, wherein the panel is a control panel having one or more adjustable controls and a display disposed thereon.

3. The movable panel assembly of claim 1, wherein the panel is configured to move from a first position to a second position responsive to operation of the cam mechanism by the stationary motor.

4. The movable panel assembly of claim 3, wherein the panel is disposed adjacent the chassis in the first position.

5. The movable panel assembly of claim 3, wherein in the second position, the panel is disposed a horizontal distance from the chassis and an upper edge of the panel is at a same height as an upper edge of an adjacent appliance functional unit.

6. The movable panel assembly of claim 1, wherein the panel includes one or more plates disposed on an inner surface of the panel, the plates operably coupled to one or more eccentric cams, wherein the one or more eccentric cams are configured to adjust the one or plates to consequently adjust a rotational orientation of the panel relative to the cam mechanism.

7. The movable panel assembly of claim 1, wherein the stationary motor is configured to vary at least one of a speed of operation or an applied torque based on a position of at least one of the first pin or second pin within the respective first channel or second channel.

8. The movable panel assembly of claim 1, wherein the stationary motor is configured to vary at least one of a speed of operation or an applied torque based on a friction or torque threshold.

9. The movable panel assembly of claim 1, wherein the stationary motor is configured to vary at least one of a speed of operation or an applied torque based on a position of the panel relative to the chassis.

10. The movable panel assembly of claim 1, further comprising a spring coupled to the plate, wherein the spring is rotatably coupled to a third pin disposed within the curved first groove and rotatably coupled to the first end of the first cam follower.

11. The movable panel assembly of claim 1, wherein the second channel of the cam plate comprises a first linear portion, a second linear portion, and an inclined portion disposed therebetween.

12. The movable panel assembly of claim 11, wherein the second linear portion is disposed at a height greater than a height of the first linear portion.

13. The movable panel assembly of claim 11, wherein each of the first and second linear portions of the second channel are substantially parallel to the first channel.

14. The movable panel assembly of claim 11, wherein the inclined portion includes a detent, the detent configured to stop translation of the second pin within the second channel.

* * * * *